US007714490B2

(12) United States Patent
Takada

(10) Patent No.: US 7,714,490 B2
(45) Date of Patent: May 11, 2010

(54) SPARK PLUG FOR INTERNAL COMBUSTION ENGINE AND RELATED MANUFACTURING METHOD

(75) Inventor: Kenichiro Takada, Kuwana (JP)

(73) Assignee: Denso Corporation, Kariya (JP)

( * ) Notice: Subject to any disclaimer, the term of this patent is extended or adjusted under 35 U.S.C. 154(b) by 478 days.

(21) Appl. No.: 11/714,127

(22) Filed: Mar. 6, 2007

(65) Prior Publication Data

US 2007/0216276 A1 Sep. 20, 2007

(30) Foreign Application Priority Data

Mar. 14, 2006 (JP) ..... 2006-069245

(51) Int. Cl.
*F02M 57/06* (2006.01)
*H01T 13/20* (2006.01)
*H01T 13/22* (2006.01)

(52) U.S. Cl. ..... 313/141; 313/118; 313/128; 313/142

(58) Field of Classification Search ..... None
See application file for complete search history.

(56) References Cited

U.S. PATENT DOCUMENTS 6,373,173 B1 * 4/2002 Suzuki ..... 313/143
6,724,132 B2 4/2004 Kanao
6,885,137 B2 4/2005 Kanao et al.

FOREIGN PATENT DOCUMENTS

JP 2002-083662 3/2002
JP 2004-172053 6/2004

* cited by examiner

*Primary Examiner*—Nimeshkumar D. Patel
*Assistant Examiner*—Natalie K Walford
(74) *Attorney, Agent, or Firm*—Nixon & Vanderhye PC

(57) ABSTRACT

A spark plug for an internal combustion engine and related manufacturing method are disclosed having a metal shell, a porcelain insulator, a center electrode and a ground electrode. The center electrode includes a substantially columnar shaped base material body, and a substantially square shaped rod-like Ir alloy tip bonded to a leading end portion of the base material body. The leading end portion has a diameter D2 smaller than a diameter D1 of the base material body. The Ir alloy tip has a square shape with a long diagonal line supposed to form a diameter A of a circumscribed circle $C_A$ of the Ir alloy tip whose inscribed circle $C_B$ is coaxial with the circumscribed circle $C_A$ and has a diameter B, with four diameters A, B, D1 and D2 lay in the relationship expressed as D1>A>D2>B.

20 Claims, 25 Drawing Sheets

SPARK PLUG FOR INTERNAL COMBUSTION ENGINE AND RELATED MANUFACTURING METHOD

CROSS REFERENCE TO RELATED APPLICATIONS

This application is based on Japanese Patent Application No. 2006-69245, filed on Mar. 14, 2006, the content of which is hereby incorporated by reference.

BACKGROUND OF THE INVENTION

1. Field of the Invention

The present invention relates to spark plugs for use in internal combustion engines of motor vehicles, cogeneration systems and gas-pressure feed pumps or the like and, more particularly, to a spark plug having long operating life and a related manufacturing method.

2. Description of the Related Art

In the related art, attempts have heretofore been made to provide spark plugs as igniting means for internal combustion engines of motor vehicles or the like.

Each of these spark plugs generally includes a center electrode and a ground electrode between which a spark discharge gap is provided. Applying a high voltage across the center electrode and the ground electrode allows a spark discharge to take place in the spark discharge gap, thereby igniting an air-fuel mixture.

With the development of internal combustion engines with increased performances in maintenance-free statuses, the spark plugs have been required to have long operating life. To satisfy such requirements, an attempt has heretofore been made to form a spark plug with a center electrode having a spark discharge portion provided with an Ir alloy tip in face of the spark discharge gap.

Here, the Ir alloy tip and a center electrode base material body, made of Ni-based alloy, have a big difference in thermal expansion coefficients. Therefore, the Ir alloy tip is liable to drop off from the center electrode base material body when exposed to thermal stresses in frequent times. To address such an issue, it has been a common practice to employ laser welding to bond the Ir alloy tip to the center electrode base material body via a fused layer having a thermal expansion coefficient in a substantially intermediate level between those of the Ir alloy tip and the center electrode base material body. This allows a reduction in thermal stress acting on the center electrode, thereby permitting the Ir alloy tip and the center electrode base material body to ensure increased bonding capability.

In such a laser welding method, the Ir alloy tip and the center electrode base material body are preliminarily unitized to each other by resistance welding or the like, after which a laser beam is irradiated onto an entire circumferential periphery of the Ir alloy tip while turning the same about an axis thereof.

Here, the center electrode has laser-welding capability that remarkably depends on contours of the Ir alloy tip and the center electrode base material body exposed to a position at which the laser beam is irradiated. If the contours of the Ir alloy tip and the center electrode base material body exposed to the laser beam irradiating position are irregular, a joint portion between the Ir alloy tip and the center electrode base material body is fused in an uneven fusing pattern with the resultant difficulty of having adequate bonding capability. To address such an issue, an Ir alloy tip processed in a columnar configuration has been used to provide a fixed profile at all times during the rotation of the Ir alloy tip when performing welding step.

However, a large number of fabricating steps need to be performed for processing the Ir alloy tip in a precisely columnar shape. With a view to addressing such a problem, U.S. Pat. No. 6,885,137 discloses a spark plug that is manufactured in a process wherein even if an Ir alloy tip has a non-roundness shape in cross section on a plane perpendicular to an axis of the Ir alloy tip, a roundness tolerance is specified such that the Ir alloy tip is bonded to a center electrode base material body with bonding capability nearly equal to that obtained with a columnar shaped Ir alloy tip.

In addition, the above U.S. patent also discloses a rod-like Ir alloy tip, formed in a polygonal shape more than hexagonal shape in cross section, which is more preferable to be used as an Ir alloy tip for the purpose of satisfying the requirements mentioned above.

Meanwhile, from a standpoint of an increase in operating life of the spark plug depending on a wearing speed of the Ir alloy tip, it is advisable for the Ir alloy tip to have a square shape in cross section. That is, the Ir alloy tip formed in such a square shape is particularly effective for a spark plug of the sidewise-facing ground electrode type with a ground electrode placed in face of an outer circumferential periphery of a center electrode.

As shown in FIGS. 29 to 31, in welding a square shaped rod-like Ir alloy tip 92 to a center electrode base material body 91, the square shaped rod-like Ir alloy tip 92 is welded to the center electrode base material body 91 with an outline circle of the center electrode base material body 91 placed in an area slightly outside a circumscribed circle of a square shape of the Ir alloy tip 92. During such welding process, uneven differences occur in distance between a circumferential sidewall of the center electrode base material body 91 and sidewalls of the square shaped rod-like Ir alloy tip 92. Thus, a fused layer 95 (see FIG. 32) tends to have unevenness in thermal expansion coefficient after laser welding has been completed.

With a structure of a center electrode 90 as shown, for instance, in FIG. 31, a sidewall 921 of the square shaped rod-like Ir alloy tip 92 is spaced from a circumferential sidewall 911 of the center electrode base material body 91 by a distance L1 in a direction vertical to the sidewall 921 of the square shaped rod-like Ir alloy tip 92.

Further, a corner 922 of the square shaped rod-like Ir alloy tip 92 is spaced from the circumferential sidewall 911 of the center electrode base material body 91 by a distance L2 in a direction along a diagonal line 923 of the square shaped rod-like Ir alloy tip 92.

Thus, the distance L1 between the sidewall 921 of the square shaped rod-like Ir alloy tip 92 and the circumferential sidewall 911 of the center electrode base material body 91 becomes greater than the distance L2 between the corner 922 of the square shaped rod-like Ir alloy tip 92 and the circumferential sidewall 911 of the center electrode base material body 91.

Accordingly, the fused layer 95 (see FIG. 32) resulting from laser welding has a Ni-rich area, influenced with material components (Ni or the like) of the center electrode base material body 91, in the vicinity of a vertical region 912 between the sidewall 921 of the square shaped rod-like Ir alloy tip 92 and the circumferential sidewall 911 of the center electrode base material body 91. Thus, the fused layer 95 has a thermal expansion coefficient deviated to that of the center electrode base material body 91 in the vicinity of the vertical region 912.

On the contrary, the fused layer 95 has an Ir rich area, influenced with material components (Ir or the like) of the square shaped rod-like Ir alloy tip 92, in the vicinity of a diagonal region 913 of the square shaped rod-like Ir alloy tip 92. Thus, the fused layer 95 has a thermal expansion coefficient deviated to that of the square shaped rod-like Ir alloy tip 92 in the vicinity of the diagonal region 913 thereof.

Thus, the fused layer 95 becomes hard to have an overall circumference having a thermal expansion coefficient in the vicinity of a value intermediate between those of the square shaped rod-like Ir alloy tip 92, containing Ir, and the center electrode base material body 91 containing Ni or the like.

Further, even if laser welding is performed under a condition to minimize a difference in thermal expansion coefficients in various areas of the fused portion on an entire circumferential periphery thereof, the fused layer 95 becomes rich in Ni or the like as a whole, causing a difficulty to occur in forming the fused layer 95 so as to have the thermal expansion coefficient in the vicinity of the intermediate value between those of the square shaped rod-like Ir alloy tip 92 and the center electrode base material body 91.

Furthermore, the corner 922 and a center of the square shaped rod-like Ir alloy tip 92 have a greater distance along the diagonal line than a distance between the sidewall 921 of the square shaped rod-like Ir alloy tip 92 and the center thereof. Therefore, the innermost fused region 95*a* of the fused layer 95 is hard to reach the center of the square shaped rod-like Ir alloy tip 92 with a concurrence of the unfused region 96 being left as shown in FIG. 32. As a result, the spark plug of the related art suffers from increased thermal stresses when exposed to thermal shocks in repeated cycles during operations in the internal combustion engine.

As set forth above, the spark plug formed in such a structure mentioned above has incapability of achieving a reduction in thermal stress with the resultant difficulty of ensuring adequate bonding capability.

Accordingly, under circumstances where the spark plug is exposed to thermal shocks in rapid heating and rapid cooling in repeated cycles, there is a fear of flaking or cracking 97 occurring in the fused layer 95 at the joint portion of the center electrode 90.

Moreover, U.S. Pat. No. 6,724,132 discloses a spark plug of a sidewise-facing ground electrode type having a center electrode provided with a noble metal tip formed in a square shape in cross section. With the spark plug of the center electrode formed in such a structure, the square shaped noble metal tip has an outer diameter larger than that of a center electrode base material body. That is, an inscribed circle of the square shaped noble metal tip is larger in diameter than the outer diameter of the center electrode base material body.

Therefore, the noble metal tip can be welded to the center electrode base material body only upon completely assembling the center electrode base material body to a porcelain insulator. Thus, an issue arises with the occurrence of deterioration in productivity of the spark plug. In addition, the fused layer of the center electrode needs to be placed in a position protruding from an end face of the porcelain insulator. This causes a limitation to occur in the positional relationship between a welding position and the end face of the porcelain insulator.

SUMMARY OF THE INVENTION

The present invention has been completed with the above view in mind and has an object to provide a spark plug for an internal combustion engine, having increased bonding capability between a center electrode base material body and an Ir alloy tip with increased productivity while having elongated operating life, and a method of manufacturing a spark plug for use in an internal combustion engine.

To achieve the above object, a first aspect of the present invention provides a spark plug for an internal combustion engine, which spark plug comprises a metal shell having an outer periphery formed with a mounting thread, a porcelain insulator fixedly secured to the metal shell on a central axis thereof, a center electrode retained within the porcelain insulator along a central axis thereof, and a ground electrode extending from the metal shell and having a leading end placed in face-to-face relationship with the center electrode to provide a spark discharge gap. The center electrode includes a center electrode base material body of a substantially columnar shape having a base material leading end portion, and a substantially square shaped rod-like Ir alloy tip bonded to the base material leading end portion of the center electrode base material body. The base material leading end portion of the center electrode base material body has a columnar shape with a diameter D2 smaller than a diameter D1 of the center electrode base material body. The square shaped rod-like Ir alloy tip has a square shape in cross section on a plane perpendicular to an axis of the Ir alloy tip with diagonal lines among which a long diagonal line is supposed to be a diameter A of a circumscribed circle $C_A$ of the Ir alloy tip and an inscribed circle $C_B$ is supposed to internally touch at least two sides of the square shape coaxially with the circumscribed circle $C_A$ of the Ir alloy tip and have a diameter B, with four diameters A, B, D1 and D2 lay in the relationship expressed as D1>A>D2>B.

With such a structure of the spark plug, the diameter D1 of the center electrode base material body, the diameter D2 of the base material leading end portion, the diameter A of the circumscribed circle $C_A$ of the Ir alloy tip and the diameter B of the inscribed circle $C_B$ lay in the relationship expressed as D1>A>D2>B. This allows the center electrode base material body and the Ir alloy tip to have increased bonding capability, while providing an increase in productivity of the spark plug.

That is, with the relevant component parts specified in dimension achieving the relationship A>D2>B, unevenness in distance between a circumferential periphery of the base material leading end portion of the center electrode base material body and a sidewall of the Ir alloy tip can be minimized over an entire circumference of a joint portion between the base material leading end portion of the center electrode base material body and the Ir alloy tip. This allows the Ir alloy tip and the center electrode base material body to be welded at the joint portion in such a way to allow materials, contained in the fused layer, to contain a homogeneous mixture through an entire circumferential area of the fused layer so as to minimize a difference thermal expansion coefficients. That is, the entire circumferential area of the fused layer can be formed of substantially and homogeneously mixed materials resulting from materials of the center electrode base material body and the Ir alloy tip. As a result, the fused layer can have a thermal expansion coefficient in the vicinity of an intermediate value between those of the center electrode base material body and the Ir alloy tip. This makes it possible to achieve a reduction in thermal stress acting on the fused layer between the center electrode base material body and the Ir alloy tip.

Accordingly, even under circumstances where the spark plug is exposed in use to thermal shocks in rapid heating and rapid cooling cycles in repeated number of times, no flaking or cracking takes place in the joint portion between the center electrode base material body and the Ir alloy tip, ensuring the spark plug to have increased bonding capability between the center electrode base material body and the Ir alloy tip.

Further, with the relationship A>D2>B, the fused layer can be formed such that a distance between an outer circumferential periphery of the joint portion between the center electrode base material body and the Ir alloy tip and a center of the Ir alloy tip can be shortened in a diagonal region along a diagonal line of the Ir alloy tip. This allows the fused layer to easily reach the center of the Ir alloy tip during a welding stage, thereby minimizing the formation of an unfused region in the fused layer between the center electrode base material body and the Ir alloy tip. This results in a reduction in thermal shock acting on between the center electrode base material body and the Ir alloy tip.

Furthermore, with the relationship D1>A, the spark plug can be assembled such that the Ir alloy tip is bonded to the center electrode base material body before the center electrode base material body is assembled to an inside of the porcelain insulator. That is, the diameter D1 of the center electrode base material body is made less than a diameter of a central through-bore of the porcelain insulator that retains the center electrode in a fixed place. In addition, the diameter A of the circumscribed circle CA of the Ir alloy tip is less than D1. Thus, both the Ir alloy tip and the center electrode base material body can pass through the central through-bore of the porcelain insulator. Therefore, the Ir alloy tip can be bonded to the center electrode base material body before the center electrode base material body is assembled to the inside of the porcelain insulator, providing an increase in productivity. Another advantage resides in a fact that no particular limitation occurs in a bonding position between the center electrode base material body and the Ir alloy tip.

Further, the Ir alloy tip formed in the substantially square shaped rod-like configuration can minimize a wearing speed of the Ir alloy tip, caused by spark discharge, making it possible to provide an ease of extending operating life of the spark plug.

As set forth above, the present invention can provide a spark plug for an internal combustion engine with a center electrode base material body and an Ir alloy tip bonded to each other with increased bonding capability to provide elongated operating life while having increased productivity.

Further, with the spark plug for the internal combustion engine of the present embodiment, the substantially square shape of the Ir alloy tip in cross section may preferably have corners formed in curved portions, respectively, and straight portions interconnecting the curved portions to each other, and wherein each straight portion may have a length L and the Ir alloy tip has a width W under the relationship expressed as $0.8\times W \leqq L < W$.

With the spark plug of such a structure, a thermal stress can be prevented from concentrating on the corner of the Ir alloy tip, while providing increased bonding capability between the Ir alloy tip and the center electrode base material body. In addition, the Ir alloy tip can have an increased surface area facing the ground electrode, enabling the spark plug to have increased operating life.

With the straight portion having the length L and the Ir alloy tip having the width W falling in the relationship $0.8\times W > L$, the Ir alloy tip has a decreased surface area facing the ground electrode, causing a fear to occur with a difficulty of having the spark plug with increased operating life.

Furthermore, with the spark plug for the internal combustion engine of the present embodiment, the ground electrode may preferably include a noble metal ship having an opposing surface, facing a sidewall of the Ir alloy tip to provide the spark discharge gap, which has a width M in relation to the length L of the straight portion under the relationship expressed as $M < L$.

With such a structure, the Ir alloy tip and the straight portion can easily provide a spark discharge, enabling the Ir alloy tip to have increased operating life.

The noble metal may be made of, for instance, Ir alloy, Pt alloy or the like.

Further, with the spark plug for the internal combustion engine of the present embodiment, the opposing surface of the noble metal tip of the ground electrode may be preferably placed in face-to-face relationship with the sidewall of the Ir alloy tip such that the opposing surface of the noble metal tip does not protrude from the sidewall of the Ir alloy tip.

With such a structure, the Ir alloy tip of the center electrode and the noble metal chip of the ground electrode can face each other in an adequate opposing surface area, enabling the Ir alloy tip to have elongated operating life.

Further, with the spark plug for the internal combustion engine of the present embodiment, the opposing surface of the noble metal tip of the ground electrode may be preferably placed in face-to-face relationship with a sidewall of the Ir alloy tip so as not to protrude from the sidewall of the Ir alloy tip in a widthwise direction thereof, and each of the curved portions of the Ir alloy tip may have a depth less than 0.3 mm along a direction in which each curved portion faces the noble metal tip of the ground electrode.

Such a structure prevents a reduction in an opposing surface area between the noble metal tip of the ground electrode and the Ir alloy tip of the center electrode, enabling the Ir alloy tip to have elongated operating life.

In a case where the depth of the curved portion of the corner of the Ir alloy tip exceeds 0.3 mm, the curved portion on the corner of the Ir alloy tip is placed in face-to-face relationship with the opposing surface of the noble metal tip of the ground electrode. When this takes place, there is a fear of the opposing surface of the Ir alloy tip wearing on an early stage with the resultant decrease in operating life. That is, if the spark discharge gap is enlarged and exceeds 0.3 mm, misfiring is liable to occur. In addition, if the depth of the curved portion exceeds 0.3 mm, the spark discharge gap has a value exceeding 0.3 mm in an increased area on an early stage between the curved portion of the Ir alloy tip and the noble metal tip of the ground electrode, with the resultant fear of an appropriate opposing surface area reducing on an early stage.

Furthermore, with the spark plug for the internal combustion engine of the present embodiment, the substantially square shape of the Ir alloy tip in cross section thereof may preferably have one of a substantially quadrate shape and a rectangular shape.

In such a case, the Ir alloy tip and the center electrode base material body can be easily positioned with respect to each other. This provides an ease of inserting the center electrode, composed of the Ir alloy tip bonded to the center electrode base material body, through the porcelain insulator. This results in capability of obtaining a spark plug with increased productivity.

Moreover, with the spark plug for the internal combustion engine of the present embodiment, the substantially square shape of the Ir alloy tip in cross section may preferably have a profile including corners formed in curved portions, respectively, and straight portions interconnecting the curved portions to each other, and wherein a square shape may be supposed to be defined with four extended lines of the straight portions with a length E of a long diagonal line among diagonal lines of the substantially square shape of the Ir alloy tip under which a virtual circumscribed circle $C_C$ is supposed to have a diameter C, corresponding to the long diagonal line among diagonal lines of the substantially square shape of the Ir alloy tip, which has the relationship expressed as $D1>C>D2\geqq E$.

In such a case, even if the curved portions of the Ir alloy tip formed on the corners thereof are placed in an inward area of the base material leading end of the center electrode base material body, the virtual circumscribed circle $C_C$ comes to be placed in a position between an outer profile of the base material body and an outer profile of the base material leading end. This enables the spark plug to have the same advantages effects as those described with reference to the first aspect of the present invention, ensuring increased bonding capability between the center electrode base material body and the Ir alloy tip.

In addition, with the spark plug for the internal combustion engine of the present embodiment, the diameter D1 of the center electrode base material body and the diameter D2 of the base material leading end portion of the center electrode base material body may preferably lay in the relationship expressed as $0.5\times D1\leqq D2\leqq 0.95\times D1$.

With such a relationship, it becomes possible to ensure bonding capability between the center electrode base material body and the Ir alloy tip, while ensuring increased operating life of the Ir alloy tip.

With the structure falling in the relationship $0.5\times D1>D2$, it becomes hard for heat, developed in the Ir alloy tip, to escape to the base end of the center electrode via the base material leading end portion, causing a fear of the occurrence of deterioration in operating life of the Ir alloy tip.

On the contrary, in case of the relationship $D2>0.95\times D1$, the spark plug encounters a difficulty of satisfying the relationship $D1>A>D2>B$, previously noted above with reference to the first aspect of the present invention, and compelling a difference between the diameter D2 of the base material leading end portion and the diameter A of the circumscribed circle $C_A$ of the Ir alloy tip to be nearly equal to a difference between the diameter D2 of the base material leading end portion and the diameter B of the inscribed circle $C_B$ of the Ir alloy tip. Thus, there is a fear of a difficulty encountered in increasing bonding capability between the center electrode base material body and the Ir alloy tip.

Moreover, with the spark plug for the internal combustion engine of the present embodiment, the diameter D1 of the center electrode base material body and the diameter D2 of the base material leading end portion of the center electrode base material body may preferably lay in the relationship expressed as $0.7\times D1\leqq D2\leqq 0.9\times D1$.

In such a case, increased bonding capability can be ensured between the center electrode base material body and the Ir alloy tip, providing a further ease of ensuring increased operating life of the Ir alloy tip.

Further, with the spark plug for the internal combustion engine of the present embodiment, the diameter D1 of the base material body of the center electrode base material body may be preferably greater than 2.5 mm.

With such a dimension of the center electrode base material body, the spark plug can adequately exhibit the advantageous effects of the present invention.

That is, in general, with the center electrode base material body having the diameter greater than 2.5 mm, a drop is liable to occur in bonding capability between the center electrode base material body and the Ir alloy tip. Therefore, applying the present invention to such a spark plug allows the spark plug to have advantageous effects of the present invention.

Furthermore, with the spark plug for the internal combustion engine of the present embodiment, the Ir alloy tip may be preferably bonded to the center electrode base material body at a joint portion where a fused layer is formed with an unfused portion being formed inside the fused layer in a width F in a correlation with the diameter A of the circumscribed circle $C_A$ of the Ir alloy tip under the relationship expressed as $F\leqq 0.2\times A$.

In such a case, an increased thermal stress is prevented from concentrating on the unfused area, ensuring bonding capability between the center electrode base material body and the Ir alloy tip.

Moreover, with the spark plug for the internal combustion engine of the present embodiment, the Ir alloy tip may be preferably bonded to the center electrode base material body at a joint portion formed with a fused layer having an entire circumference spaced from a bore end of a through-bore of the porcelain insulator by a distance greater than 0.1 mm.

In such a case, an adequate clearance can be provided between the bore end of the through-bore of the porcelain insulator and the fused layer of the center electrode. Thus, even if remnants of combustion gases accumulate on the bore end of the porcelain insulator, adverse affects of the remnants on the porcelain insulator can be suppressed.

That is, in a case where the fused layer is spaced from the bore end of the porcelain insulator by a distance less than 0.1 mm, there is a fear of remnants resulting from combustion of fuel gas and accumulating in an area between the bore end and the fused layer of the center electrode with the resultant occurrence of clogging. When this takes place, thermal stress occurs in between both component parts due to a difference in thermal expansion coefficients of the center electrode and the porcelain insulator. This results in a fear of thermal stress acting on the porcelain insulator with the resultant occurrence of cracking. In another case, engine vibrations cause the center electrode leading end portion to vibrate and a stress acts on the porcelain insulator due to the remnants accumulated on the bore end of the porcelain insulator, causing a fear to take place with the occurrence of cracking.

Thus, permitting the fused layer to be spaced from the bore end of the porcelain insulator by a distance greater than 0.1 mm prevents the porcelain insulator from damage.

Besides, with the spark plug for the internal combustion engine of the present embodiment, the center electrode may have an annular space defined between an insulator leading end portion and an outer periphery of the joint portion between the Ir alloy tip and the center electrode base material body, and the joint portion may preferably have an inward boundary edge exposed to the annular space of the center electrode.

With such a structure, the temperature rise of the fused portion can be avoided, thereby enabling the fused layer to be prevented from thermal stress in excess.

Further, with such a structure of the fused layer, the bore end of the porcelain insulator and the fused layer is separate from each other over an entire circumference of the fused layer by a distance greater than 0.1 mm, making it possible to effectively prevent the porcelain insulator from damage.

Further, with the spark plug for the internal combustion engine of the present embodiment, the ground electrode may preferably comprise a ground electrode base body having a trailing end connected to the metal shell and a leading end to which a noble metal tip is bonded in face-to-face relationship with a sidewall of the center electrode to define the spark discharge gap.

With such a structure, the noble metal tip of the ground electrode can face the Ir alloy tip in an increased surface area, thereby enabling the Ir alloy tip to have increased operating life.

Further, with the spark plug for the internal combustion engine of the present embodiment, the porcelain insulator may preferably have an insulator leading end portion axially extending through the metal shell and ended at a position axially inward of a leading end of the metal shell, and the base material leading end portion of the base material body may be spaced from the insulator leading end portion of the porcelain insulator through an annular space, wherein the joint portion between the Ir alloy tip and the base material leading end portion is exposed to the annular space between the base material leading end portion of the base material body and the insulator leading end portion of the porcelain insulator.

With such a structure, the base material leading end portion of the base material body is spaced from the insulator leading end portion of the porcelain insulator through the annular space and the joint portion between the Ir alloy tip and the base material leading end portion is exposed to the annular space between the base material leading end portion of the base material body and the insulator leading end portion of the porcelain insulator. In such a case, the bore end of the through-bore of the porcelain insulator and the fused layer of the center electrode can be separate from each other through the annular space. Thus, even if remnants of combustion gases accumulate on the bore end of the porcelain insulator, adverse affects of the remnants on the porcelain insulator can be suppressed. This prevents the porcelain insulator from damage due to a stress arising from such remnants.

Furthermore, with the spark plug for the internal combustion engine of the present embodiment, the Ir alloy tip and the base material leading end portion may be preferably bonded to each other at the joint portion through a fused layer having an inward boundary edge exposed to the annular space between the base material leading end portion of the base material body and the insulator leading end portion of the porcelain insulator.

With such a structure, the temperature rise of the fused portion can be avoided, thereby enabling the fused layer to be prevented from thermal stress in excess.

Moreover, with the spark plug for the internal combustion engine of the present embodiment, the fused layer of the joint portion may preferably have an outer circumferential periphery spaced from the leading end portion of the porcelain insulator through the annular space by a given distance.

With such a structure of the fused layer, the fused layer is separate from the bore end of the porcelain insulator over an entire circumference of the fused layer by a given distance, making it possible to effectively prevent the porcelain insulator from damage.

Besides, with the spark plug for the internal combustion engine of the present embodiment, the Ir alloy tip of the center electrode may preferably have side surfaces, each having a corner and a straight portion L, and a width W that lies in the relationship expressed as $0.8 \times W \leqq L < W$.

With such a structure, the Ir alloy tip of the center electrode can have an adequate opposing surface area in opposition to the ground electrode, enabling the spark plug to have increased operating life.

In addition, with the spark plug for the internal combustion engine of the present embodiment, the curved portion of the Ir alloy tip of the center electrode may preferably have a depth falling in a value less than 0.3 mm.

The presence of the Ir alloy tip having the corners with each depth laying in a value less than 0.3 mm enables the prevention of a reduction in an opposing surface area of the Ir alloy tip of the center electrode, thereby enabling the spark plug to have prolonged operating life.

A second aspect of the present invention provides a method of manufacturing a spark plug for an internal combustion engine, comprising the steps of preparing a metal shell having an outer periphery formed with a mounting thread, preparing a porcelain insulator, preparing a center electrode having a substantially columnar shaped center electrode base material body having a base material leading end portion and a substantially square shaped rod-like Ir alloy tip bonded to the base material leading end portion of the center electrode base material body by laser welding, inserting the center electrode through the porcelain insulator in a fixed place, and inserting the porcelain insulator, with which the center electrode is supported, in the metal shell. The base material leading end portion of the center electrode base material body has a columnar shape with a diameter D2 smaller than a diameter D1 of the center electrode base material body. The square shaped rod-like Ir alloy tip has a square shape in cross section on a plane perpendicular to an axis of the Ir alloy tip with diagonal lines among which a long diagonal line is supposed to be a diameter A of a circumscribed circle $C_A$ of the Ir alloy tip and an inscribed circle $C_B$ is supposed to internally touch at least two sides of the square shape coaxially with the circumscribed circle $C_A$ of the Ir alloy tip and have a diameter B, with four diameters A, B, D1 and D2 lay in the relationship expressed as D1>A>D2>B.

With such a spark plug manufacturing method, the relevant component parts of the spark plug are defined in specified dimensions such that the diameter D1 of the center electrode base material body, the diameter D2 of the base material leading end portion of the center electrode base material body, the diameter A of the circumscribed circle $C_A$ of the Ir alloy tip and the diameter B of the inscribed circle $C_B$ lay in the relationship expressed as D1>A>D2>B. This allows the center electrode base material body and the Ir alloy tip to have increased bonding capability, while providing increase in productivity of the spark plug.

That is, satisfying the relationship A>D2>B enables unevenness in distance between a circumferential sidewall of the base material leading end portion of the center electrode base material body and a sidewall of the Ir alloy tip to be minimized over an entire circumference of the joint portion. This allows the Ir alloy tip and the center electrode base material body to be welded at the joint portion through the fused layer formed of homogeneously mixed materials resulting from materials of the center electrode base material body and the Ir alloy tip over an entire circumferential area of the fused layer. This results in a reduction in a difference between thermal expansion coefficients over the entire circumferential area of the fused layer.

That is, the entire circumferential area of the fused layer can be formed of substantially and homogeneously mixed materials containing materials of the center electrode base material body and the Ir alloy tip. As a result, the fused layer can have a thermal expansion coefficient in the vicinity of an intermediate value between those of the center electrode base material body and the Ir alloy tip. This makes it possible to achieve a reduction in thermal stress acting on between the center electrode base material body and the Ir alloy tip.

Accordingly, even under circumstances where the spark plug is exposed in use to thermal shocks in rapid heating and rapid cooling cycles in repeated number of times, no flaking or cracking takes place in the joint portion between the center electrode base material body and the Ir alloy tip, ensuring bonding capability between the center electrode base material body and the Ir alloy tip.

With the method of manufacturing the spark plug for the internal combustion engine according to the present invention, the porcelain insulator may have an insulator leading end portion axially extending through the metal shell and ended at a position axially inward of a leading end of the metal shell, and the base material leading end portion of the base material body may be spaced from the insulator leading end portion of the porcelain insulator through an annular space, wherein the joint portion between the Ir alloy tip and the base material leading end portion is exposed to the annular space between the base material leading end portion of the base material body and the insulator leading end portion of the porcelain insulator.

With such a manufacturing method, the base material leading end portion of the base material body is spaced from the insulator leading end portion of the porcelain insulator through the annular space and the joint portion between the Ir alloy tip and the base material leading end portion is exposed to the annular space between the base material leading end portion of the base material body and the insulator leading end portion of the porcelain insulator. In such a case, the bore end of the through-bore of the porcelain insulator and the fused layer of the center electrode can be separate from each other through the annular space. Thus, even if remnants of combustion gases accumulate on the bore end of the porcelain insulator, adverse affects of the remnants on the porcelain insulator can be suppressed. This prevents the porcelain insulator from damage due to a stress arising from such remnants.

With the method of manufacturing the spark plug for the internal combustion engine according to the present invention, the Ir alloy tip and the base material leading end portion may be preferably bonded to each other at the joint portion through a fused layer having an inward boundary edge exposed to the annular space between the base material leading end portion of the base material body and the insulator leading end portion of the porcelain insulator.

With such a manufacturing method, the temperature rise of the fused portion can be avoided, thereby enabling the fused layer to be prevented from thermal stress in excess.

With the method of manufacturing the spark plug for the internal combustion engine according to the present invention, the fused layer of the joint portion may preferably have an outer circumferential periphery spaced from the leading end portion of the porcelain insulator through the annular space by a given distance.

With such a manufacturing method, the fused layer is separate from the bore end of the porcelain insulator over an entire circumference of the fused layer by a given distance, making it possible to effectively prevent the porcelain insulator from damage.

DETAILED DESCRIPTION OF THE PREFERRED EMBODIMENTS

Figure 1:
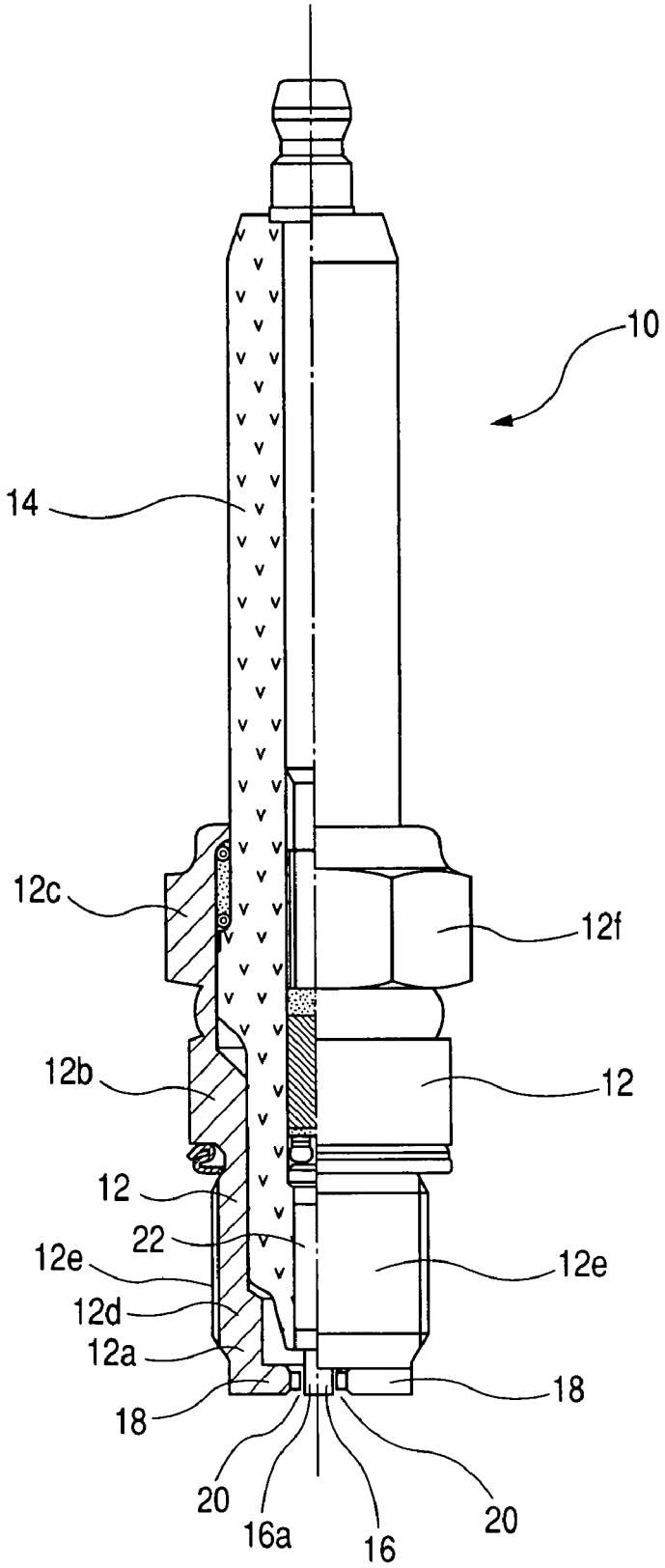
FIG. 1 is a half cross-sectional view showing an overall structure of a spark plug of a first embodiment according to the present invention.

Now, spark plugs of various embodiments according to the present invention are described below in detail with reference to the accompanying drawings. However, the present invention is construed not to be limited to such embodiments described below and technical concepts of the present invention may be implemented in combination with other known technologies or the other technology having functions equivalent to such known technologies.

In the following description, like reference characters designate like or corresponding parts throughout the several views. Also in the following description, description on the same component parts of one embodiment as those of another embodiment is omitted, but it will be appreciated that like reference numerals designate the same component parts throughout the drawings.

The sparks plugs of the various embodiments according to the present invention can be employed as igniting means for internal combustion engines of, for instance, an automotive vehicle, a cogeneration system and a gas-pressure feed pump or the like.

In the following description, a distal end of the spark plug inserted to a combustion chamber of the internal combustion engine is referred to as a "leading end" and the opposite side is referred to as a "base end".

First Embodiment

A spark plug of a first embodiment according to the present invention is described below in detail with reference to FIG. 1 to 14 of the accompanying drawings.

Figure 2:
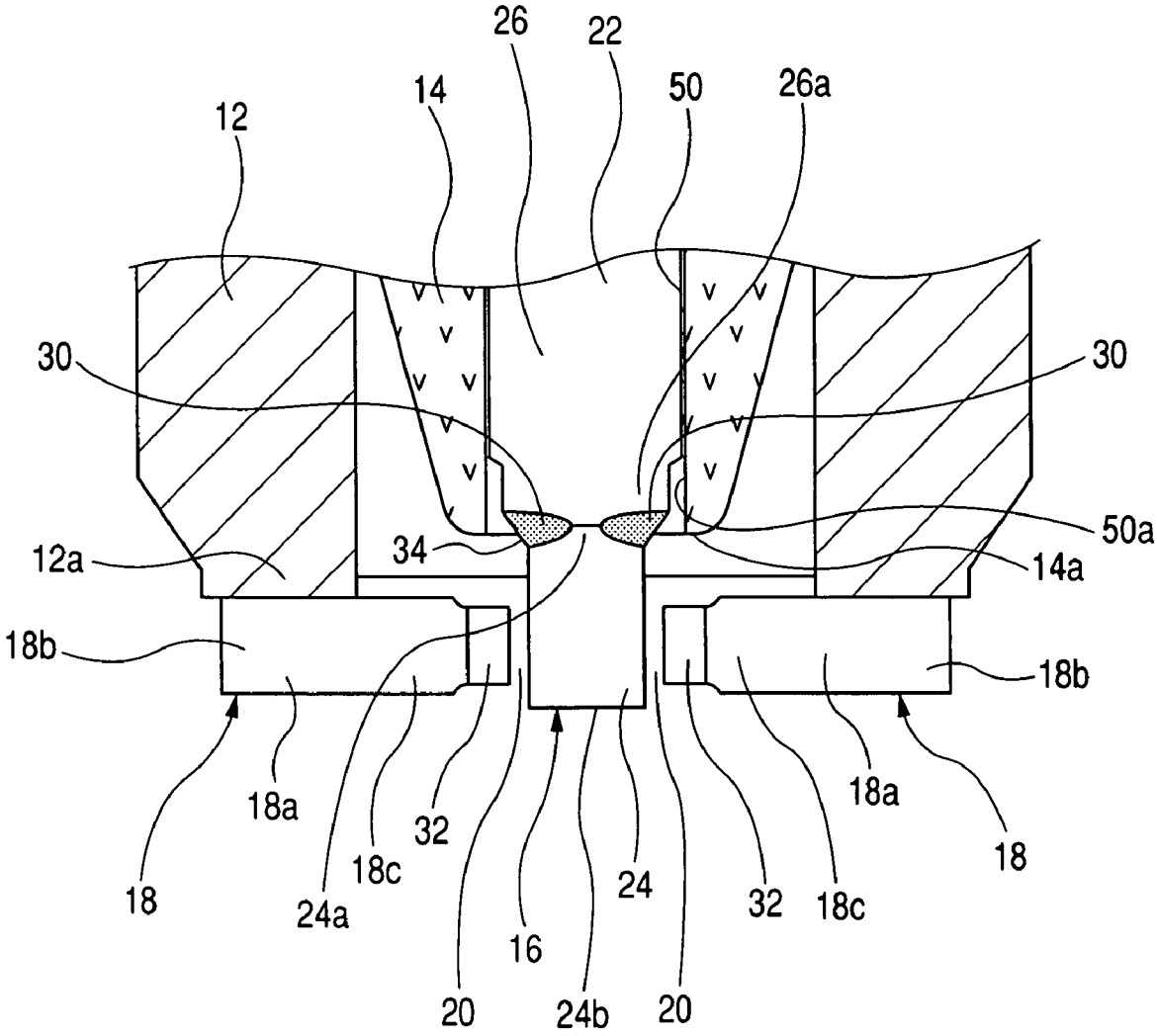
FIG. 2 is an enlarged cross-sectional view showing a spark discharge portion and its vicinity of the spark plug shown in FIG. 1.
Figure 3:
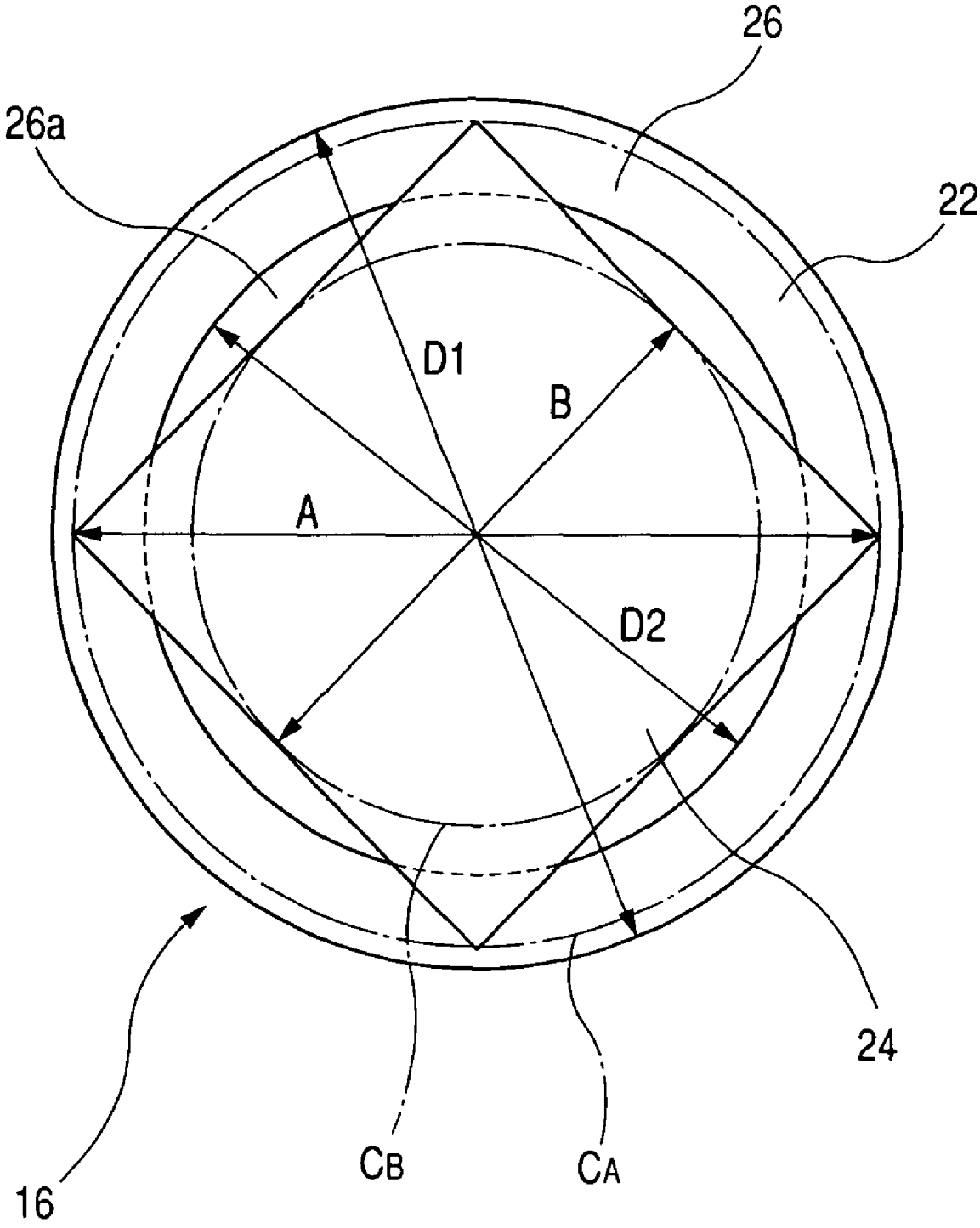
FIG. 3 is a plan view of the spark plug of the first embodiment, shown in FIG. 1, as viewed from a distal end of a center electrode thereof.

As shown in FIGS. 1 to 3, the spark plug 10 of the present embodiment comprises a cylindrical metal shell 12, an porcelain insulator 14 fixedly held with the cylindrical metal shell 12 and extending in a central axis thereof, a center electrode 16 fixedly supported with the porcelain insulator 14 in a central axis thereof, and ground electrodes 18 fixedly bonded to a leading end 12*a* of the cylindrical metal shell 12 to provide spark discharge gaps 20 with respect to a leading end 16*a* of the center electrode 16.

The cylindrical metal shell 12 includes an intermediate body 12*b*, an upper section 12*c* and a lower section 12*d*. The upper section 12*c* has an outer circumferential periphery formed in a hexagonal shape and acting as a tool-fitting section 12*f*. The lower section 12*d* of the cylindrical metal shell 12 has an outer circumferential periphery formed with a mounting thread 12*e* to be screwed into an engine block (not shown).

Figure 4:
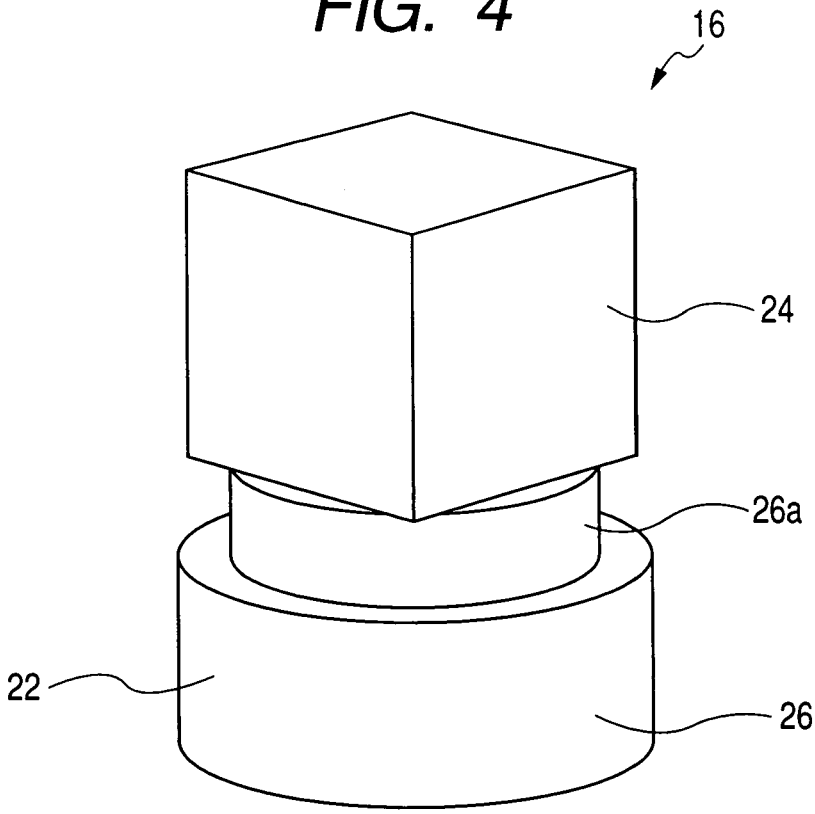
FIG. 4 is a perspective view showing the center electrode of the spark plug of the first embodiment shown in FIG. 1.
Figure 5:
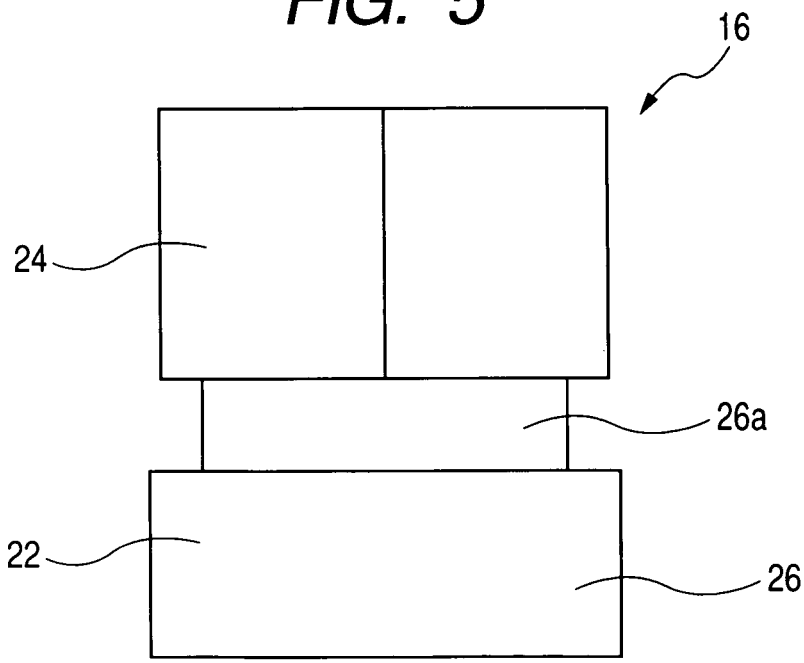
FIG. 5 is a side view showing the center electrode of the spark plug of the first embodiment shown in FIG. 1.

As shown in FIGS. 3 to 5, the center electrode 16 comprises a substantially columnar shaped center electrode base material body 22, made of Ni-based alloy, and a substantially square shaped rod-like Ir alloy tip 24 bonded to the center electrode base material body 22. The center electrode base material body 22 includes a base material body 26 having a downwardly extending base body leading end 26*a*.

Figure 6:
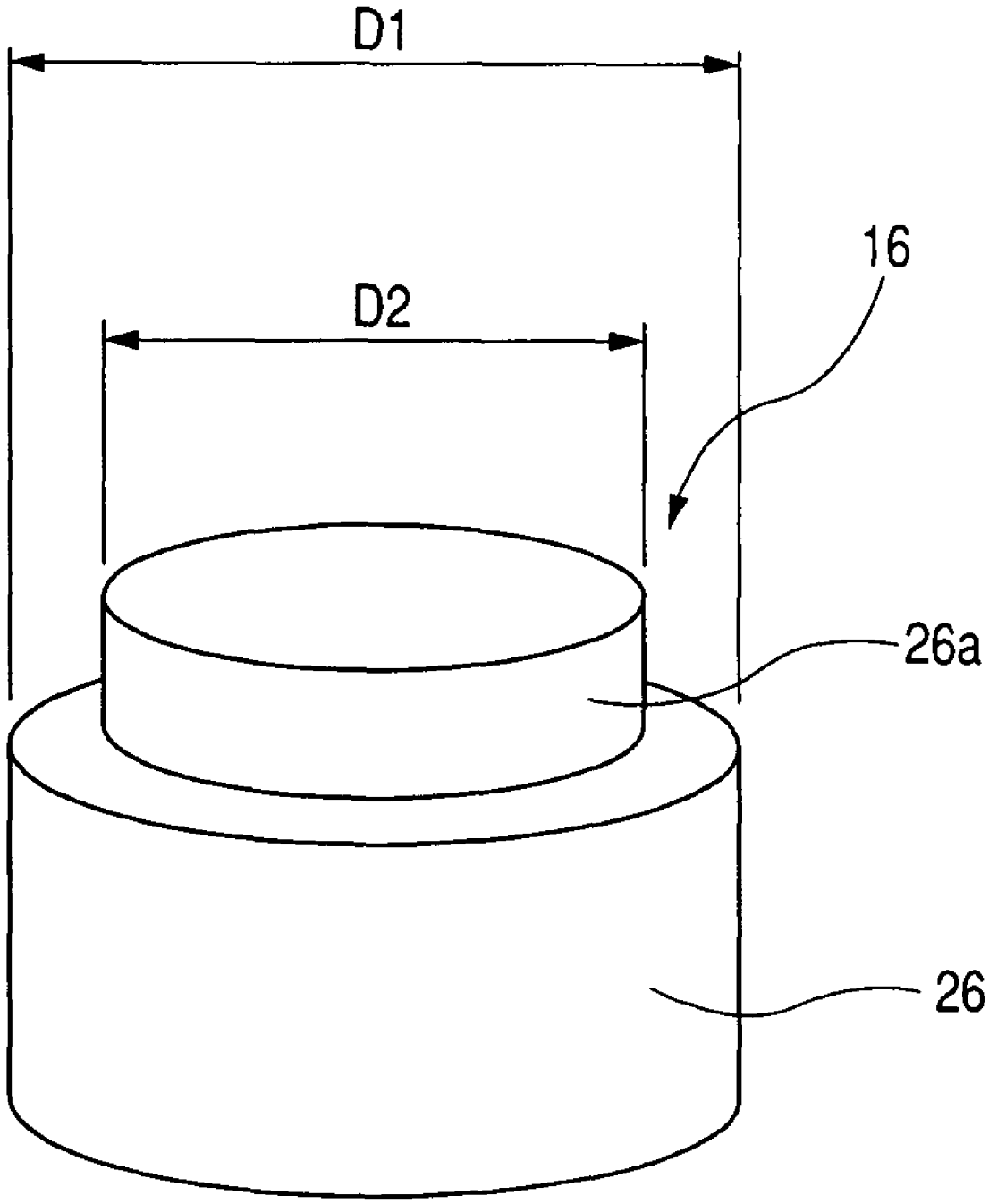
FIG. 6 is a perspective view showing a base material body of the center electrode forming part of the spark plug of the first embodiment shown in FIG. 1.

As shown in FIGS. 1, 2 and 6, the base body leading end 26*a* of the center electrode base material body 22 has a columnar shape with a diameter D2 smaller than a diameter D1 of the base material body 26.

Meanwhile, the center electrode base material body 22 and the Ir alloy tip 24 are specified in a particular dimensional relationship and placement relationship as described below in detail.

As shown in FIG. 3, a substantially square shape representing a cross section of the square shaped rod-like Ir alloy tip 24 and perpendicular to an axis thereof includes a long diagonal line A and a short diagonal line B with a circumscribed circle CA of the Ir alloy tip supposed to have a diameter equal to a length of the long diagonal line A. In addition, the substantially square shape representing the cross section of the square shaped rod-like Ir alloy tip 24 has an inscribed circle $C_B$ with a diameter equal to a length of the short diagonal line B. In such a case, the four diameters A, B, D1, D2 are specified in the relationship expressed as D1>A>D2>B. In addition, with the spark plug 10 of the present embodiment, two diagonal lines have an equal length and the circumscribed circle $C_A$ of the Ir alloy tip is held in contact with four corners of the substantially square shape. Moreover, the inscribed circle $C_B$ internally touches four sides of the substantially square shape.

The spark plug 10 of the present embodiment is applied as a spark plug of a cogeneration gas engine. In installation, the spark plug 10 is screwed into a threaded bore of an engine head (not shown), in which a combustion chamber is defined, and fixedly mounted on the engine head.

As set forth above, the spark plug 10 includes the cylindrical metal shell 12, serving as a housing, which is made of electrically conductive steel (such as, for instance, low carbon steel or the like). The porcelain insulator 14, made of alumina ceramic ($Al_2O_3$) or the like, is fixedly supported within the cylindrical metal shell 12.

The center electrode base material body 22 is made of a substantially columnar body composed of inner material, including metallic material such as copper or the like excellent in heat conductivity, and outer material including metallic material such as nickel-based alloy or the like excellent in heat resistance and corrosion resistance.

The Ir alloy tip 24 has an upper end (trailing end) 24*a* welded to the base body leading end 26*a* such that the Ir alloy tip 24 extends downward from an insulator leading end portion 14*a* to be exposed in an area around the spark discharge gaps 20 as shown in FIG. 2.

Meanwhile, each ground electrode 18, made of Ni-based alloy or the like, has a trailing end 18*b* bonded to the leading end 12*a* of the cylindrical metal shell 12 by welding. In addition, each ground electrode 18 takes the form of a columnar body (such as, for instance, a square column) and has the leading end 18*a* extending toward the center electrode 16 in face-to-face relation with a side face of the center electrode 16.

Figure 15:
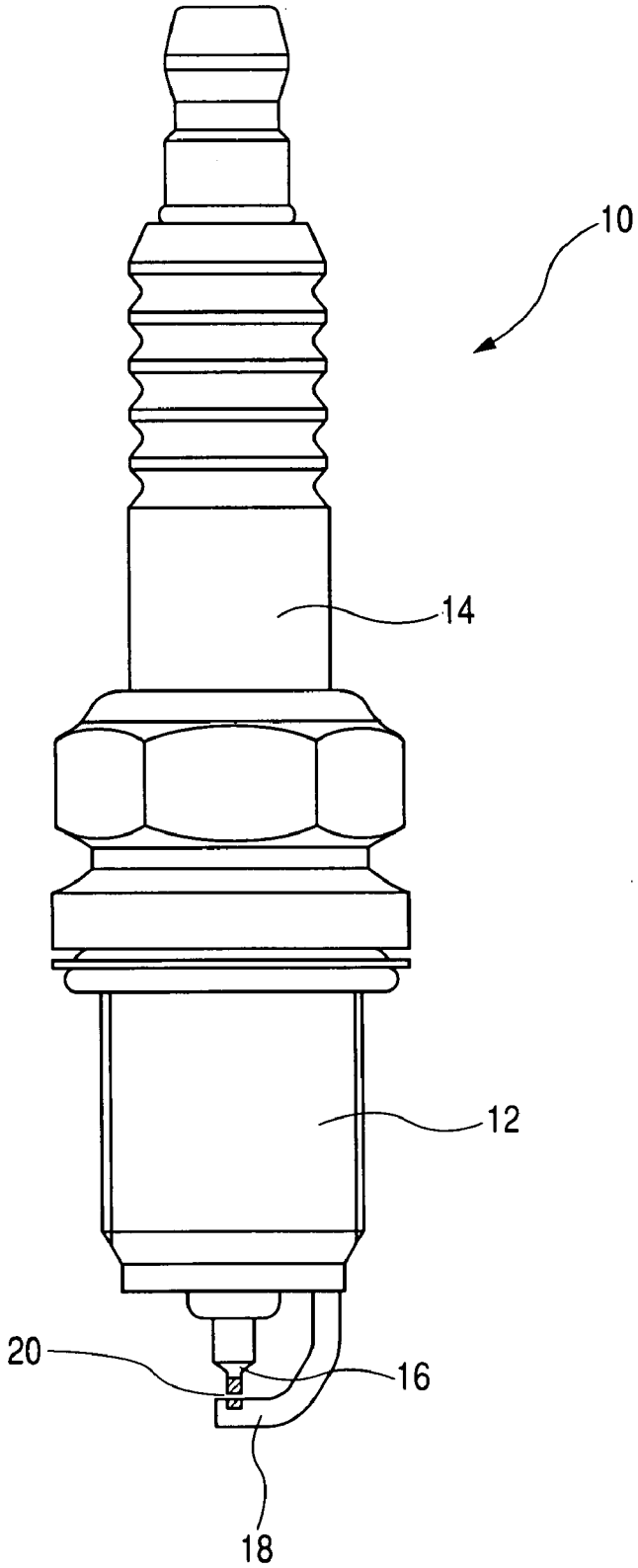
FIG. 15 is a half cross-sectional view showing an overall structure of a modified form of the spark plug of the first embodiment shown in FIG. 1 with a ground electrode having a leading end placed in opposition to a distal end of the center electrode.

While the spark plug 10 is shown with reference to the embodiment in which the plural ground electrodes 18 provide a plurality of spark discharge gaps 20, it will be appreciated that the spark plug 10 may include one ground electrode 18 with one spark discharge gap 20. In an alternative, the spark plug 10 may be modified in structure so as to allow a leading end of a ground electrode to be placed in face-to-face relation with a leading end of a center electrode as shown in FIG. 15.

Further, the Ir alloy tip (center electrode tip) 24, composed of a square shaped rod made of Ir alloy, is bonded to the base body leading end 26*a* of the center electrode base material body 22 by welding as shown in FIG. 2. In addition, each of the ground electrode 18 includes a ground electrode base body 18*a* having a ground electrode trailing end 18*b*, bonded to the leading end 12*a* of the cylindrical metal shell 12, and a ground electrode leading end 18*c*. An Ir alloy tip (ground electrode tip) 32, made of square shaped rod-like Ir alloy, is bonded to the ground electrode leading end 18*c* of each ground electrode base body 18*a*. The Ir alloy tips 32 are placed in face-to-face relationship with the leading end 24*b* of the Ir alloy tip 24 of the center electrode 16. More particularly, the Ir alloy tip 32 of each ground electrode 18 is placed in opposition to one side face of the Ir alloy tip 24 of the square shaped rod-like center electrode 16.

In addition, the Ir alloy tip 32 of each ground electrode 18 may have a columnar shape in cross section.

In fabricating the center electrode 16, the square shaped rod-like Ir alloy tip 24 is bonded to the leading end 26*a* of the center electrode base material body 22 by circumferential welding using laser welding as shown in FIGS. 2 and 7 and FIGS. 12 to 14.

Figure 12:
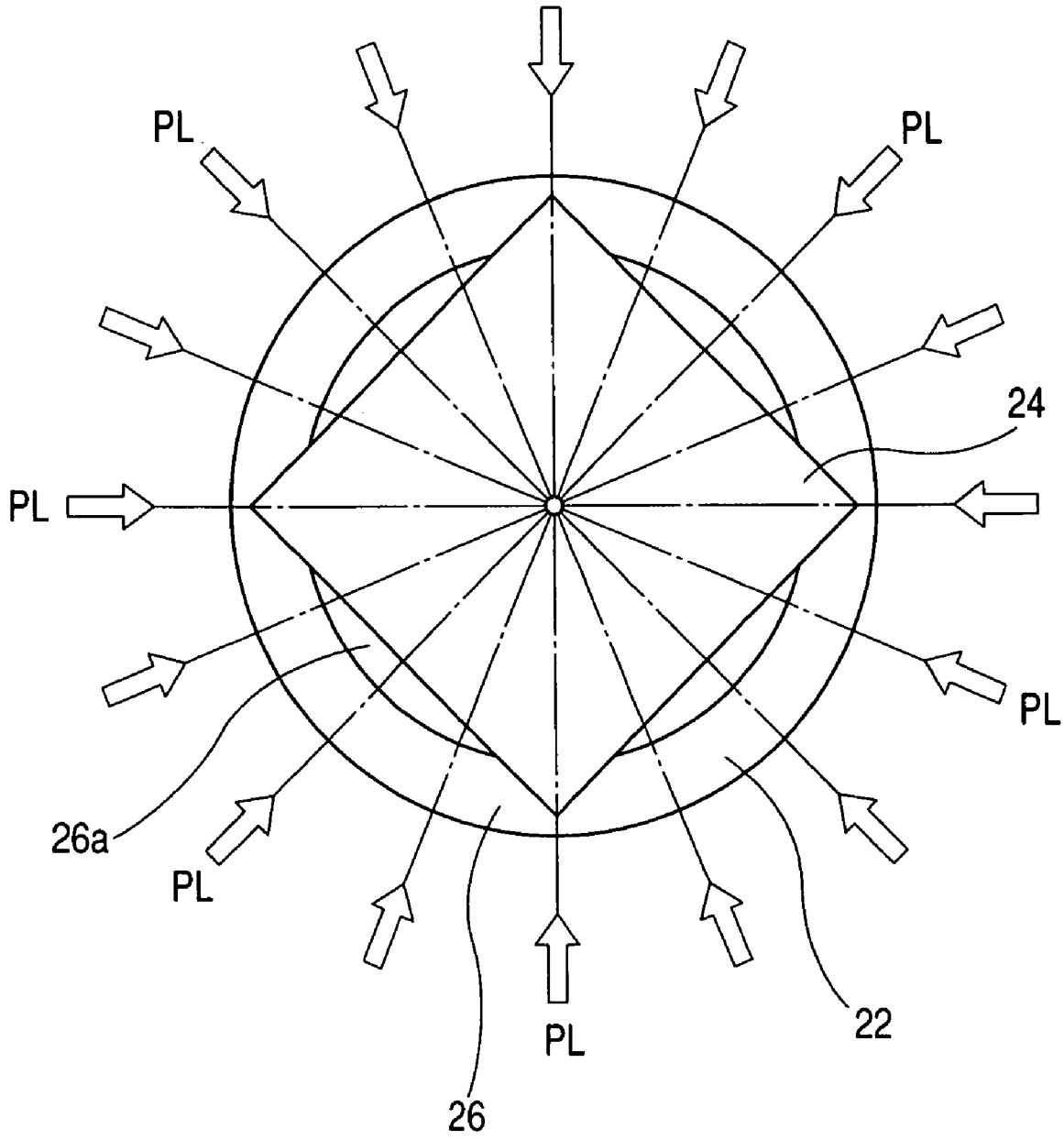
FIG. 12 is an illustrative view showing the center electrode, as viewed from a distal end thereof, in which the center electrode base material body and the Ir alloy tip are bonded to each other by a laser welding operation using 16-point equiangular laser beams being irradiated to the joint portion.
Figure 13:
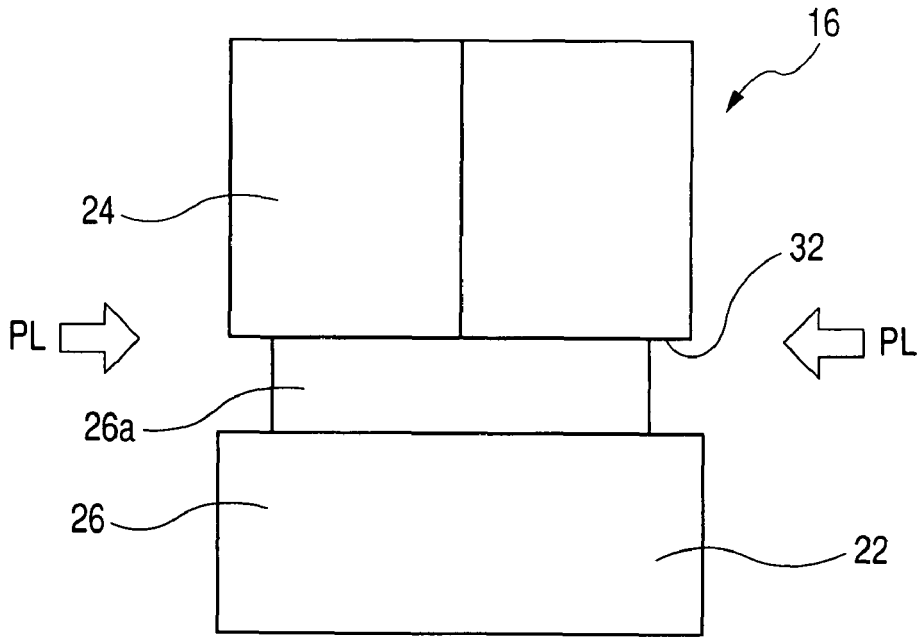
FIG. 13 is an illustrative view of the center electrode, as viewed from a side area, showing a structure with the center electrode base material body and the Ir alloy tip bonded to each other by the laser welding operation shown in FIG. 12.
Figure 14:
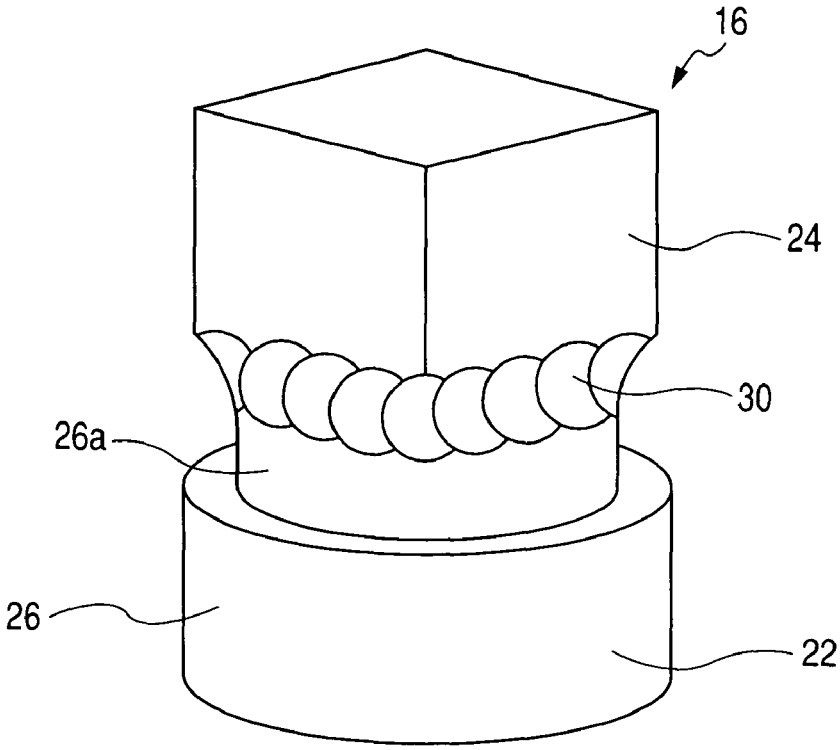
FIG. 14 is a perspective view of the center electrode, forming part of the spark plug of the first embodiment shown in FIG. 1, with the center electrode base material body and the Ir alloy tip bonded to each other by laser welding.

That is, in bonding the Ir alloy tip 24 to the center electrode base material body 22, the square shaped rod-like Ir alloy tip 24 is preliminarily unitized with the leading end 26*a* of the center electrode base material body 22 by resistance welding or the like. Thereafter, the square shaped rod-like Ir alloy tip 24 is completely bonded to the leading end 26*a* of the center electrode base material body 22 by laser welding. This laser welding is performed by irradiating a pulse laser beam PL onto a contact area (joint portion) 34 between the leading end 26*a* of the base material body 26 and the trailing end (upper end) 24*a* of the Ir alloy tip 24 at sixteen irradiating points circumferentially and equidistantly spaced from each other while turning the base material body 26 about an axis thereof as shown in FIGS. 12 and 13. Thus, performing laser welding on the joint portion 34 allows the center electrode 16 to be fabricated in a structure shown in FIG. 14.

With such a structure of the center electrode 16 resulting form laser welding, the center electrode base material body 22 and the Ir alloy tip 24 are bonded to each other via a fused layer 30.

Moreover, each Ir alloy tip 32 and each ground electrode base body 18*a* are also bonded to each other through a fused layer 30 formed by laser welding.

With the present embodiment, moreover, while the spark plug 10 is shown with reference to a structure including the center electrode 16 and the ground electrodes 18 with the Ir alloy tip 24 and the Ir alloy tips 32 bonded to the center electrode 16 and the ground electrodes 18 to be exposed to the spark discharge gaps 20, the present invention is not limited to such a structure. That is, the present invention may be implemented even in a modified structure with the Ir alloy tip 24 provided onto only the center electrode 16.

Further, each of the Ir alloy tips 24 and 32 preferably contains Ir of more than 50% by weight and at least one additive with a melting point exceeding a temperature of 2000° C. At least one additive may include material of one kind selected from the group consisting of Pt, Rh, Ni, W, Pd, Ru, Os, Al, Y and $Y_2O_3$. This is because the spark plug 10 has an advantage of Ir with a high melting point higher than 2000° C. while having adequate wear-resistance against spark discharges.

Turning back to FIG. 3, further, the Ir alloy tip 24 of the center electrode 16 has the substantially square shape in cross section that is shaped in a quadrate.

Figure 10:
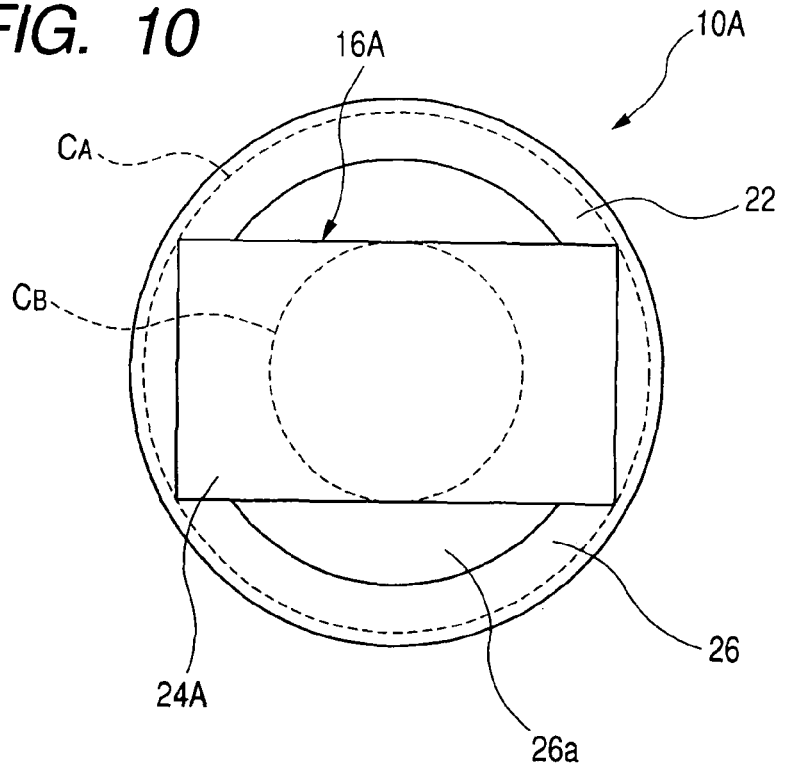
FIG. 10 is a plan view of a center electrode of a modified form of the spark plug of the first embodiment shown in FIG. 1 with the center electrode formed in a substantially rectangular in cross section.

FIG. 10 is a schematic view showing a spark plug 10A in an alternative form. As shown in FIG. 10, the spark plug 10A in the alternative form includes a center electrode 16A provided with an Ir alloy tip 24A having a rectangular shape in cross section.

With the spark plug 10A having the center electrode 16A provided with the rectangular Ir alloy tip 24A, a circle internally touching both parallel sides with a short distance corresponds to the inscribed circle $C_B$.

Figure 11:
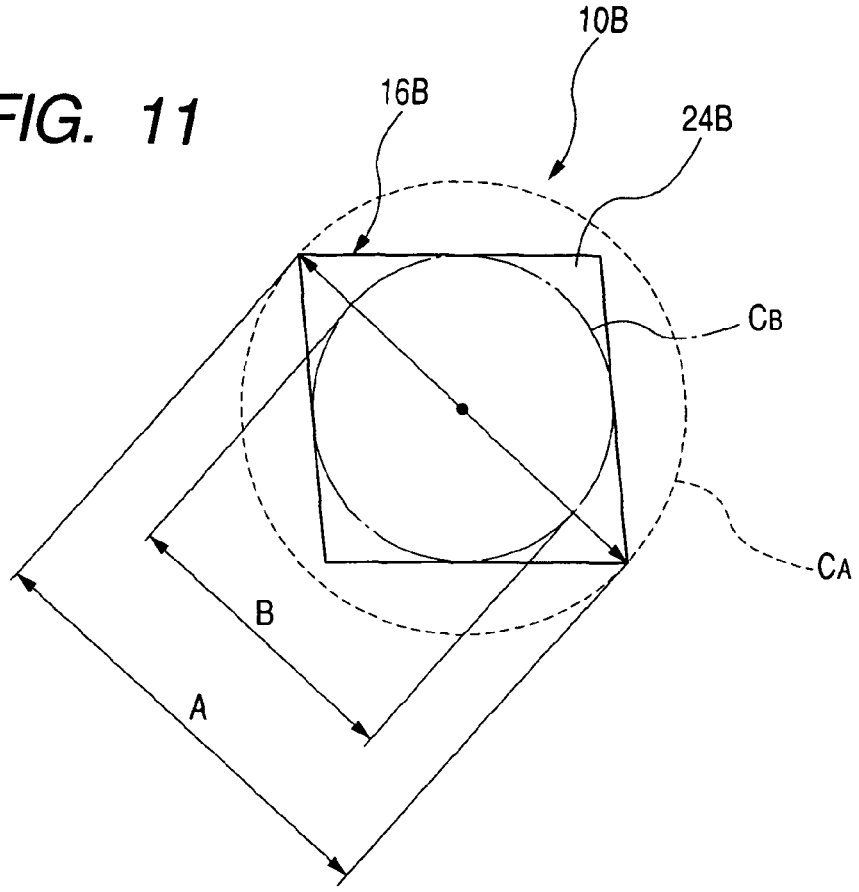
FIG. 11 is a plan view of a center electrode of another modified form of the spark plug of the first embodiment shown in FIG. 1 with the center electrode formed in a substantially rhombic shape in cross section.

FIG. 11 is a schematic view showing a spark plug 10B in another alternative form. As shown in FIG. 11, the spark plug 10B in another alternative form includes a center electrode 16B provided with an Ir alloy tip 24B having a rhombic shape in cross section. In still another alternative, the spark plug 10B may take the other rectangular form in cross section depending on needs.

With the spark plug 10B having the center electrode 16B provided with the Ir alloy tip 24B having a cross section other than the square shape and the rectangular shape, a circumscribed circle with a diameter taking a long diagonal line corresponds to the circumscribed circle CA of the Ir alloy tip as shown in FIG. 11.

As shown in FIGS. 3 and 6, further, the base material body 26 and the base material leading end portion 26*a* have diameters D1, D1 falling in the relationship expressed as $0.5\times D1 \leqq D2 \leqq 0.95\times D1$ and, more preferably, in the relationship expressed as $0.7\times D1 \leqq D2 \leqq 0.9\times D1$.

Furthermore, the base material body 26 of the center electrode base material body 22 is selected to have a diameter D1 greater than 2.5 mm.

Figure 7:
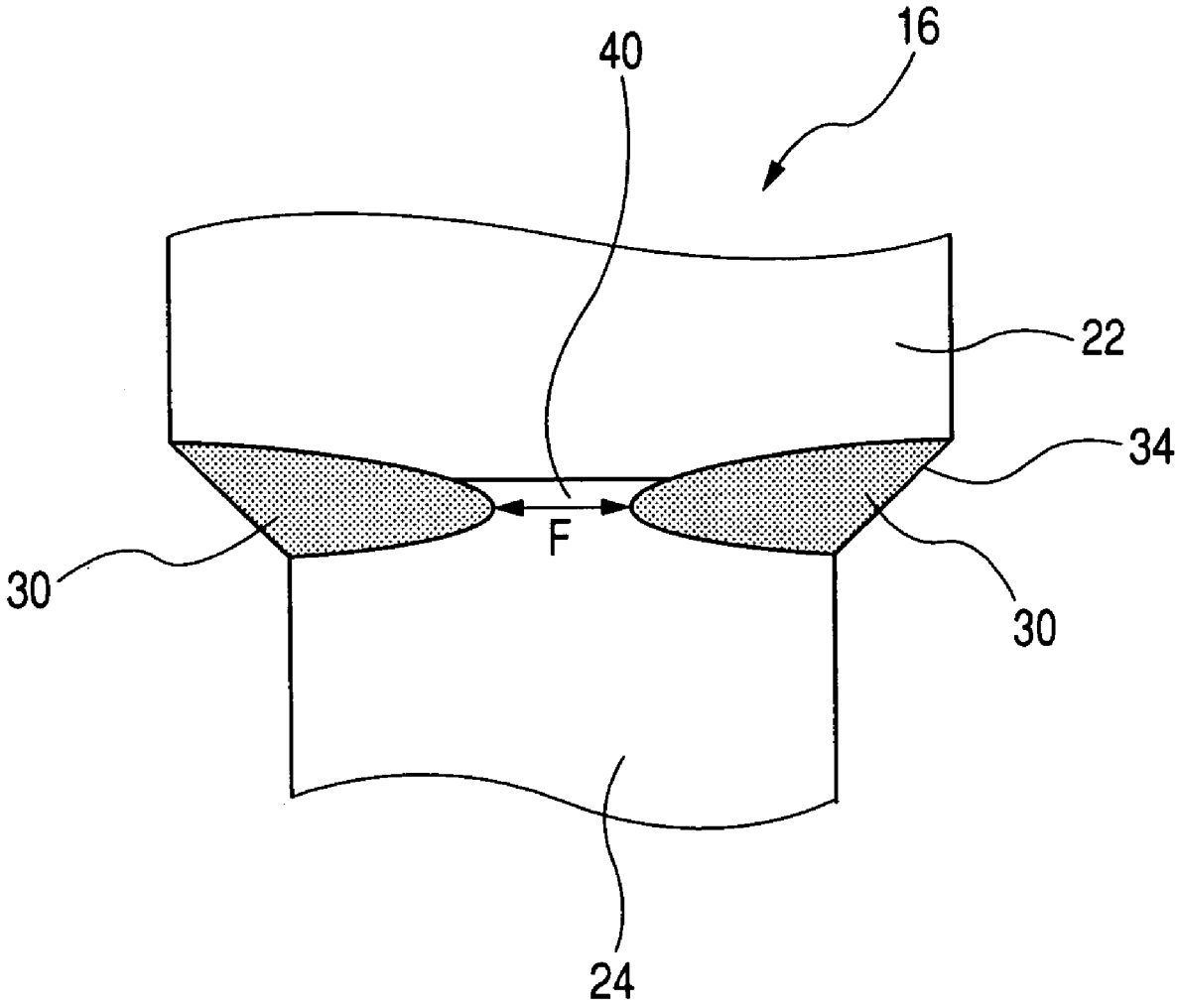
FIG. 7 is an enlarged illustrative view showing a joint portion between the center electrode base material body and an Ir alloy tip forming the spark plug of the first embodiment shown in FIG. 1.

In addition, as shown in FIG. 7, the fused layer 30, formed in the joint portion 34 between the base material leading end portion 26*a* of the center electrode base material body 22 and the Ir alloy tip 24, has a given depth in a radial direction of the center electrode 16 to provide an unfused portion 40 formed in a width F. The width F of the unfused portion 40 and the diameter A (see FIG. 3) of the circumscribed circle CA of the Ir alloy tip lie in the relationship expressed as F≦0.2×A.

Figure 8:
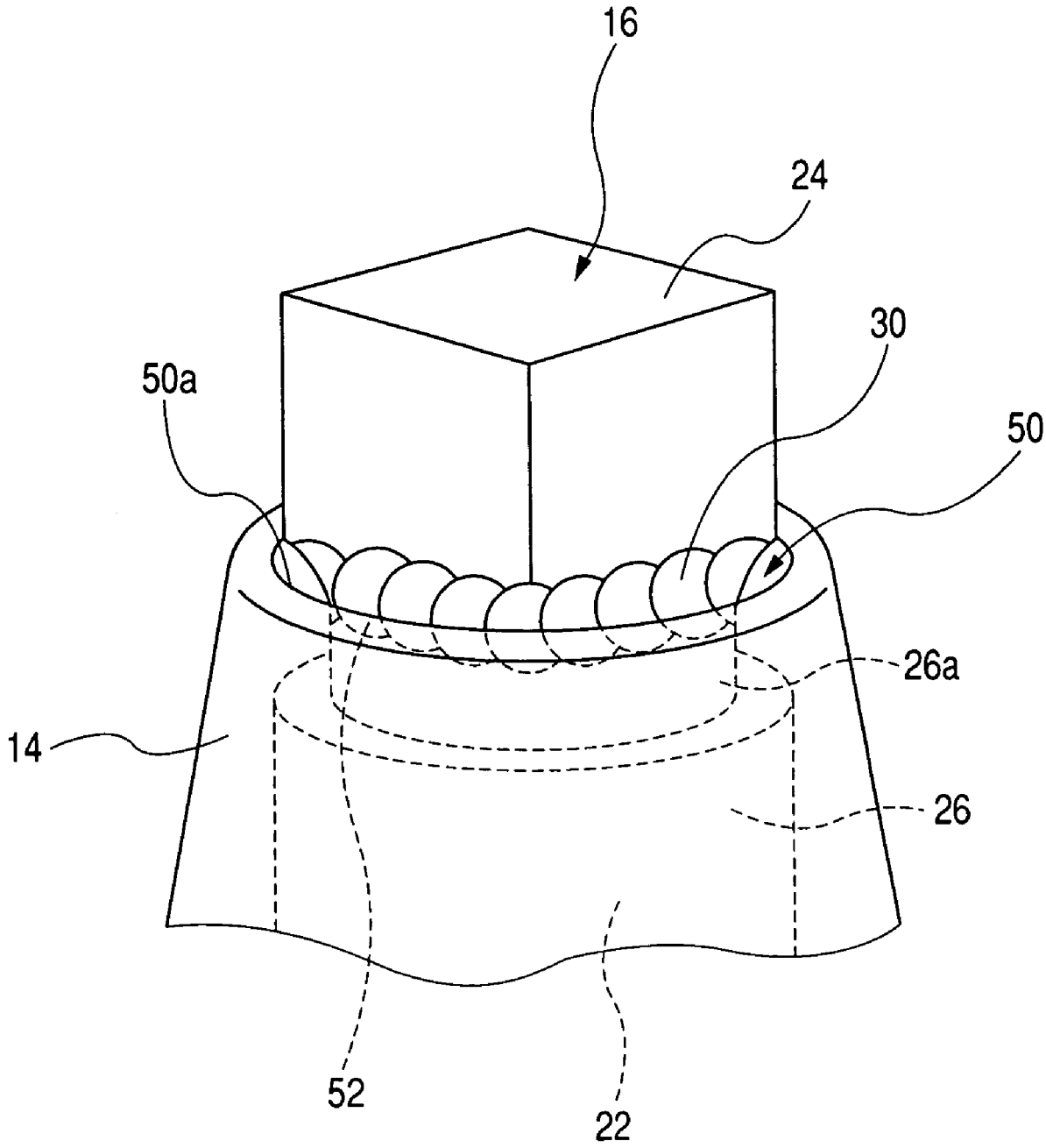
FIG. 8 is an enlarged perspective view showing the center electrode under a condition supported with a porcelain insulator.
Figure 9:
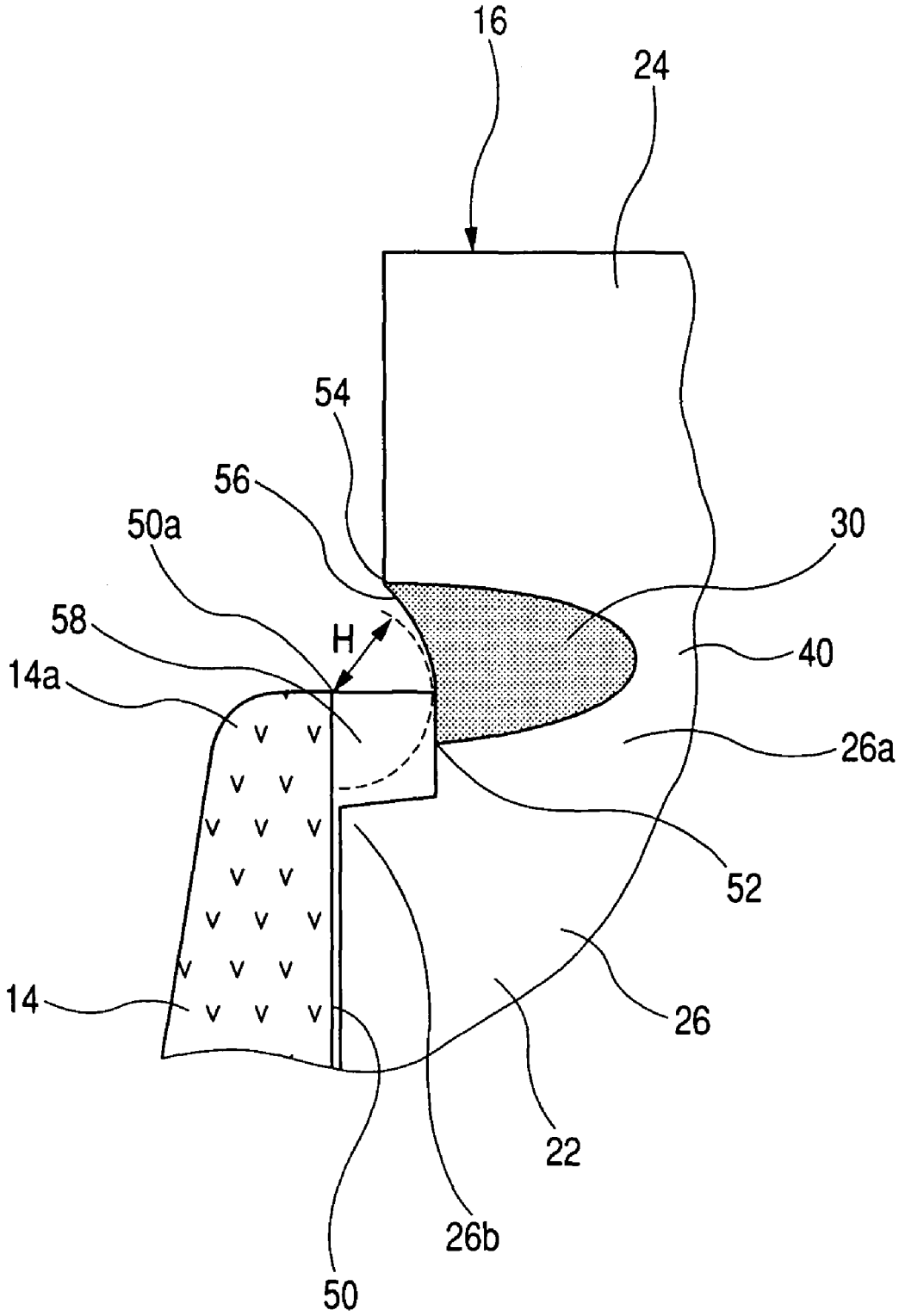
FIG. 9 is an enlarged illustrative view showing a positional relationship between the porcelain insulator and the center electrode.

Further, as shown in FIGS. 2, 8 and 9, the center electrode base material body 22 extends through the center through-bore 50 of the porcelain insulator 14 in concentric relationship therewith.

As best shown in FIG. 9, the fused layer 30 includes an inward boundary edge 52, formed in the base material leading end portion 26*a* of the base material body 26, and an outward boundary edge 54 formed in the Ir alloy tip 24, with the inward and outward boundary edges 52, 54 being contiguous with each other via a curved outer profile 56. The base material body 26 of the center electrode base material body 22 has a leading end formed with an annular shoulder 26*b* that is exposed to an annular space 58, defined between the insulator leading end portion 14*a* and the base material leading end portion 26*a*, to which the inward boundary edge 52 of the fused layer 30 is also exposed.

As shown in FIGS. 8 and 9, the curved outer profile 56 of the fused layer 30 is spaced from the bore end 50*a* of the center through-bore 50 formed in the porcelain insulator 14 by a radial distance H greater than 0.1 mm over an entire circumference of the bore end 50*a* of the center through-bore 50.

In addition, with such a structure of the center electrode 16, the inward boundary edge 52 of the fused layer 30 faces the annular space 58 defined between the insulator leading end portion 14*a* and the base material leading end portion 26*a*.

The spark plug 10 of the present embodiment formed in such a structure has advantages effects listed below.

As shown in FIG. 3, the diameter D1 of the base material body 26 of the center electrode base material body 22, the diameter D2 of the base material leading end portion 26*a*, the diameter A of the circumscribed circle CA of the Ir alloy tip 24 and the diameter B of the inscribed circle $C_B$ have the relationship expressed as D1>A>D2>B. This allows the center electrode base material body 22 and the Ir alloy tip 24 to ensure increased bonding capability, making it possible to provide an increase in productivity of the spark plug 10.

That is, with the dimensional relationship A>D2>B, the spark plug 10 can have a minimized unevenness in distance between a circumferential periphery of the base material leading end portion 26*a* of the center electrode base material body 22 and a sidewall of the Ir alloy tip 24. This allows the fused layer 30 to be formed of substantially and homogeneously mixed materials containing materials of the center electrode base material body 22 and the Ir alloy tip 24 over an entire circumference of the fused layer 30.

As a result, the fused layer 30 becomes possible to have thermal expansion coefficient in agreement with thermal expansion coefficient in the vicinity of an intermediate value between those of the center electrode base material body 22 and the Ir alloy tip 24. This enables a remarkable reduction in thermal stresses acting on the fused layer 30 between the center electrode base material body 22 and the Ir alloy tip 24.

Accordingly, even under circumstances where the spark plug 10 is frequently exposed to thermal shocks in rapid heating and rapid cooling in repeated cycles, no flaking or cracking occurs on the joint portion 34 between the base material leading end portion 26*a* of the center electrode base material body 22 and the Ir alloy tip 24 to ensure increased bonding capability between the center electrode base material body 22 and the Ir alloy tip 24. Thus, the spark plug 10 can have highly increased operating life even exposed to thermal shocks in repeated cycles.

With the spark plug 10 achieving such a dimensional relationship expressed as A>D2>B, furthermore, a distance between an outer circumferential periphery of the joint portion 34 between the base material leading end portion 26*a* of the center electrode base material body 22 and the Ir alloy tip 24 and a center of the Ir alloy tip 24 can be shortened even in an area in a diagonal region of the Ir alloy tip 24. Therefore, the fused layer 30 is liable to reach the center of the Ir alloy tip 24 upon completion of laser welding, preventing the formation of the unfused region 40 in a widened area of the Ir alloy tip 24. That is, the base material leading end portion 26*a* of the center electrode base material body 22 and the Ir alloy tip 24 can be bonded to each other at the joint portion 34 with a minimized unfused region 40. This results in a reduction in thermal stresses acting on an area between the center electrode base material body 22 and the Ir alloy tip 24.

With the diameter D1 of the base material body 26 of the center electrode base material body 22 and the diameter A of the circumscribed circle $C_A$ of the Ir alloy tip 24 falling in the relationship expressed as D1>A, moreover, the Ir alloy tip 24 can be bonded to the center electrode base material body 22 before inserting the center electrode base material body 22 to the through-bore 50 of the porcelain insulator 14 on an assembling stage of the spark plug 10. That is, since the diameter D1 of the center electrode base material body 22 is made less than a diameter of the center through-bore 50 of the porcelain insulator 14, both the Ir alloy tip 24 and the porcelain insulator 14 can be passed through the center through-bore 50 of the porcelain insulator 14. Therefore, the Ir alloy tip 24 can be bonded to the center electrode base material body 22 before the center electrode base material body 22 is retained in the porcelain insulator 14, providing increased productivity of the spark plug 10. In addition, another advantage resides in the fact that a less limitation occurs in a bonding position between the center electrode base material body 22 and the Ir alloy tip 24.

Further, since the Ir alloy tip 24 takes the substantially square pole configuration, a wearing speed of the Ir alloy tip 24 resulting from spark discharge can be maintained at a low level, making it easy to allow the spark plug 10 to have prolonged operating life.

Moreover, with the diameter D1 of the center electrode base material body 22 and the diameter D2 of the base material leading end portion 26*a* falling in the relationship as expressed as 0.5×D3≦D2≦0.95×D1, the Ir alloy tip 24 can be bonded to the center electrode base material body 22 with increased bonding capability, making it possible to increase operating life of the Ir alloy tip 24.

That is, with the diameter D1 of the center electrode base material body 22 and the diameter D2 of the base material leading end portion 26*a* satisfying relationship expressed as 0.5×D1≦D2, heat developed in the Ir alloy tip 24 can be easily transferred to a base end portion of the center electrode 16 via the base material leading end portion 26*a*. This results in an increase in operating life of the Ir alloy tip 24.

In addition, with the relationship established as D2≦0.95×D1, a difference between the diameter D2 of the base material leading end portion 26*a* and the diameter A of the circumscribed circle $C_A$ of the Ir alloy tip 24 becomes possible to be substantially equal to a difference between the diameter D2 of the base material leading end portion 26*a* and the diameter B of the inscribed circle $C_B$ of the Ir alloy tip 24 while establishing the relationship D1>A>D2>B. This results in a capability for the Ir alloy tip 24 and the center electrode base material body 22 to be bonded to each other with increased bonding capability.

Moreover, with the relationship established as $0.7\times D1 \leqq D2 \leqq 0.9\times D1$, the Ir alloy tip 24 and the center electrode base material body 22 can be bonded to each other with increased bonding capability. This enables the Ir alloy tip 24 to have increased operating life in a further easy fashion.

Further, the diameter D1 of the center electrode base material body 22 lies in a value greater than 2.5 mm, the spark plug 10 of the present embodiment can exhibit the advantageous effect of the present invention in adequate fashion. That is, in general practice, with a spark plug having a center electrode base material body with a diameter greater than 2.5 mm, the center electrode base material body and an Ir alloy tip suffers from deterioration in bonding capability (see fifth embodiment). Therefore, applying the present invention to such a spark plug results in capability for the spark plug to adequately exhibit the advantageous effect of the present invention.

Further, the width F (see FIG. 7) of the unfused region 40 inside the fused layer 30, formed in the joint portion 34 between the center electrode base material body 22 and the Ir alloy tip 24, have the relationship expressed as $F \leqq 0.2\times A$. This prevents increased thermal stress from occurring on the unfused region 4, making it possible to ensure increased bonding capability between the center electrode base material body 22 and the Ir alloy tip 24.

As shown in FIG. 9, furthermore, the fused layer 30 has the outer circumferential periphery 56 whose overall circumference is spaced from the bore end 50*a* of the insulator leading end portion 14*a* of the porcelain insulator 14 by the distance H greater than 0.1 mm. This enables an adequate clearance to be provided between the bore end 50*a* of the insulator leading end portion 14*a* and the diffused layer 30. Therefore, even if residuals of combustion gases accumulate on the bore end 50*a*, no adverse affect occurs on the porcelain insulator 14. That is, adequately ensuring the distance H between the bore end 50*a* and the curved surface 56 of the fused layer 30 results in a capability of preventing the residuals, caused by combustion of fuel gas, from clogging between the bore end 50*a* and the fused layer 30. Therefore, no cracking takes place in the porcelain insulator 14 with no occurrence of thermal stresses occurring on between the center electrode 16 and the porcelain insulator 14.

Moreover, the fused layer 30 is formed in the joint portion 34 between the center electrode base material body 22 and the Ir alloy tip 24 such that the inward boundary edge 52 is present in the annular space 58 between the insulator leading end portion 14*a* and the fused layer 30 of the center electrode 16. Thus, this enables a reduction in temperature rise of the fused layer 30, making it possible to prevent the occurrence of excessive thermal stress in the fused layer 30.

In addition, with the center electrode 16 formed in such a structure, the inward boundary edge 52 of the fused layer 30 is spaced from the bore leading edge 50*a* of the center through-bore 50 of the porcelain insulator 14 by the distance H greater than 0.1 mm over the entire circumference of the bore end 50*a*, less damage occurs on the porcelain insulator 14 in an effective fashion.

Further, with the Ir alloy tip 24 formed the substantially square shape to be quadrate in cross section, the center electrode base material body 22 and the Ir alloy tip 24 can be positioned with respect to each other in an easy fashion. This provides an ease for the center electrode 16, including the Ir alloy tip 24 bonded to the center electrode base material body 22, to be inserted through the porcelain insulator 16. This results in a capability of obtaining the spark plug 10 with increased productivity.

With the spark plug 10 of the present embodiment, as set forth above, it becomes possible to provide a spark plug for an internal combustion engine that has increased bonding capability between a center electrode base material body and an Ir alloy tip while having elongated operating life with increased productivity of the spark plug.

Second Embodiment

A spark plug 10C of a second embodiment according to the present invention is described below with reference to FIGS. 16 to 20.

The spark plug 10C of the present embodiment differs from the gas sensor 1 of the first embodiment in that the spark plug 10C includes a center electrode 16C having an Ir alloy tip 24C, formed in a substantially square shape in cross section on a plane perpendicular to an axis of the center electrode 16C, which has flat side surfaces 60 with four corners formed with rounded chamfered portions (curved portions) 60*a*.

Figure 17:
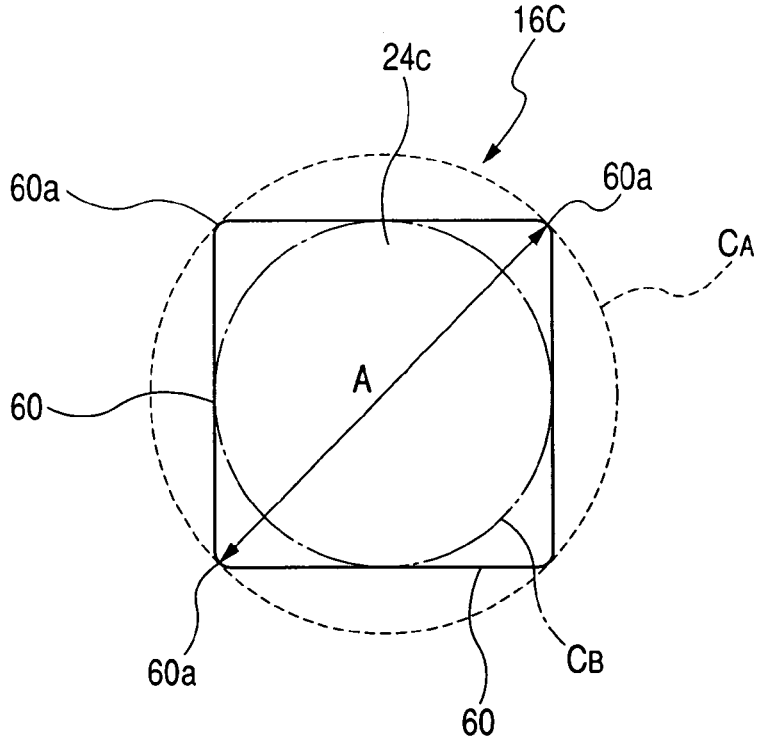
FIG. 17 is an illustrative view showing the Ir alloy tip of a center electrode with a substantially quadrate shape in cross section.

As shown in FIG. 17, the Ir alloy tip 24C has a diagonal line A extending between a pair of the curved portions 60*a* in a diagonal direction. A circumscribed circle with a diameter equal to the diagonal line A corresponds to the circumscribed circle $C_A$ Of the Ir alloy tip expressed in the first embodiment. The spark plug 10C of the present embodiment satisfies the relationship of the first embodiment expressed as $D1>A>D2>B$.

Figure 16:
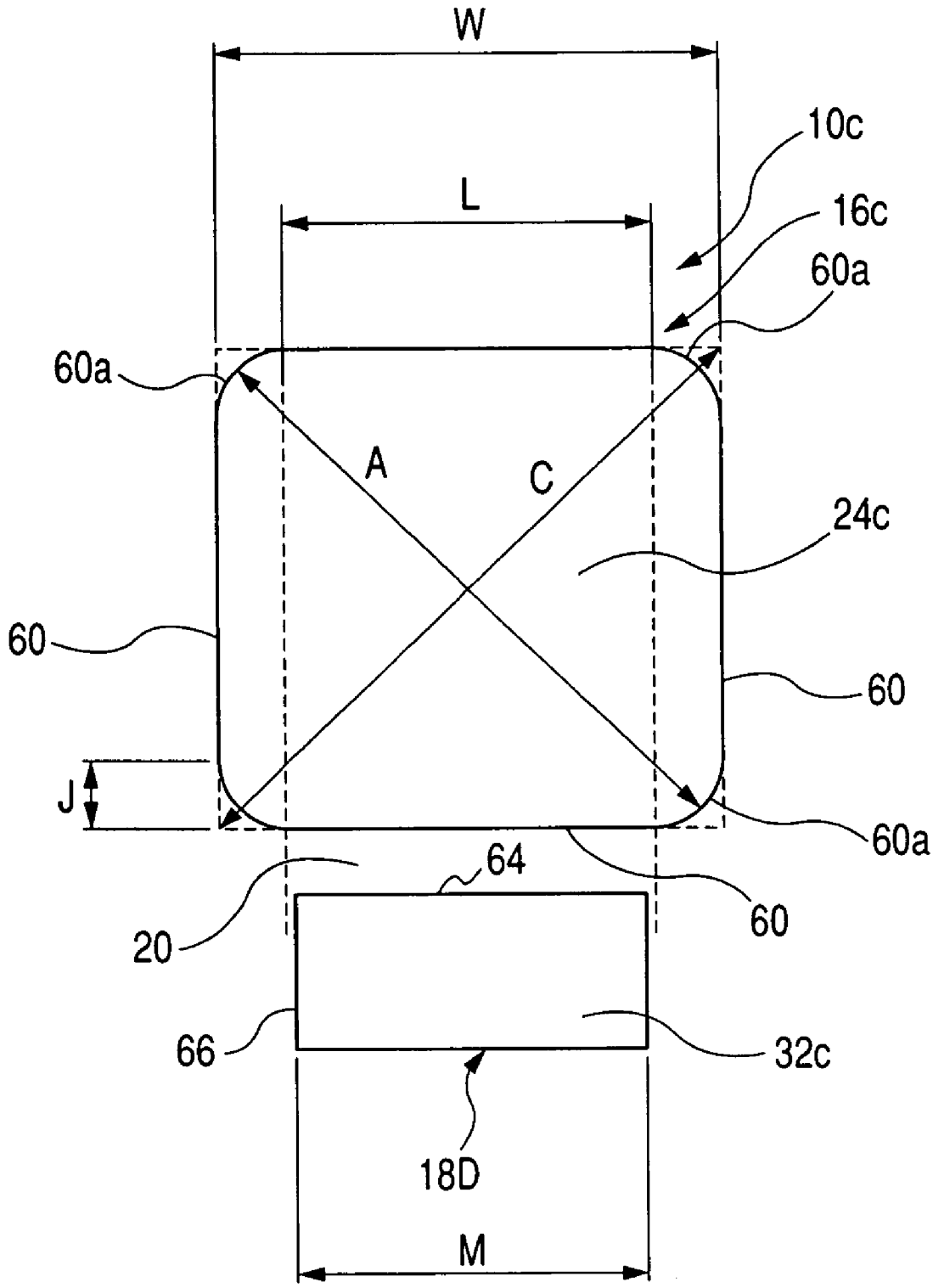
FIG. 16 is an illustrative view showing the positional relationship between an Ir alloy tip of a center electrode and a noble metal tip of a ground electrode forming a spark plug of a second embodiment according to the present invention.
Figure 18:
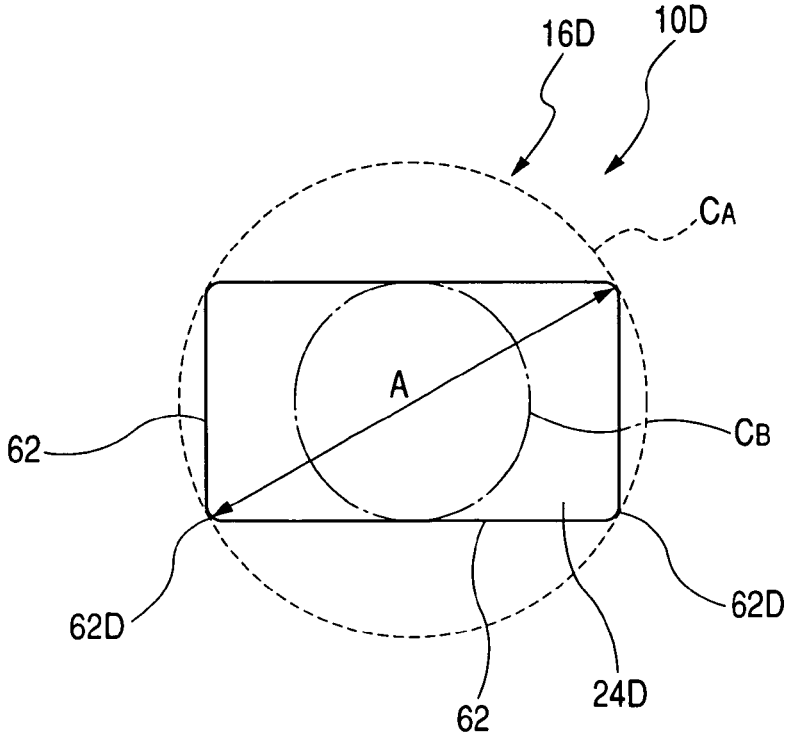
FIG. 18 is an illustrative view showing the Ir alloy tip of a center electrode with a substantially rectangular shape in cross section.

As shown in FIG. 18, further, the spark plug 10C may be altered such that a center electrode 16D includes an Ir alloy tip 24D that is rectangular in cross section having side surfaces 62 with four corners formed with curved portions 62D like those of the center electrode 16C of the second embodiment shown in FIGS. 16 and 17. Even with such a structure of the Ir alloy tip 24D, the relational formula mentioned above can be satisfied.

As shown in FIG. 16, further, the Ir alloy tip 32C has the side surface 60 with a straight portion L and a width W that lies in the relationship expressed as $0.8\times W \leqq L < W$.

Further, the length L of the straight portion of the side surface 60 of the Ir alloy tip 24C and a width M of an opposing surface 64 of an Ir alloy tip 32C, forming part of a ground electrode 18D, facing the side surface 60 of the Ir alloy tip 24C have the relationship expressed as $M<L$.

Furthermore, the opposing surface 64 of the Ir alloy tip 32C, placed in face of the lateral side surface 60 of the Ir alloy tip 24C of the center electrode 16C, is dimensioned not to protrude from the vertical side surfaces 60 of the Ir alloy tip 24C. As shown in FIG. 16, more preferably, the opposing surface 64 of the Ir alloy tip 32C is set not to protrude from the straight portion L of the lateral surface 60 of the Ir alloy tip 24C. However, even if a sidewall 66 of the Ir alloy tip 32C partly protrudes from the straight portion 60 of the Ir alloy tip 24C, the Ir alloy tip 32C of the ground electrode 18D is set in a position not to cause the sidewall 66 of the Ir alloy tip 32C from protruding from the side surface 60 of the Ir alloy tip 24C of the center electrode 16C as shown in FIG. 19.

Figure 20:
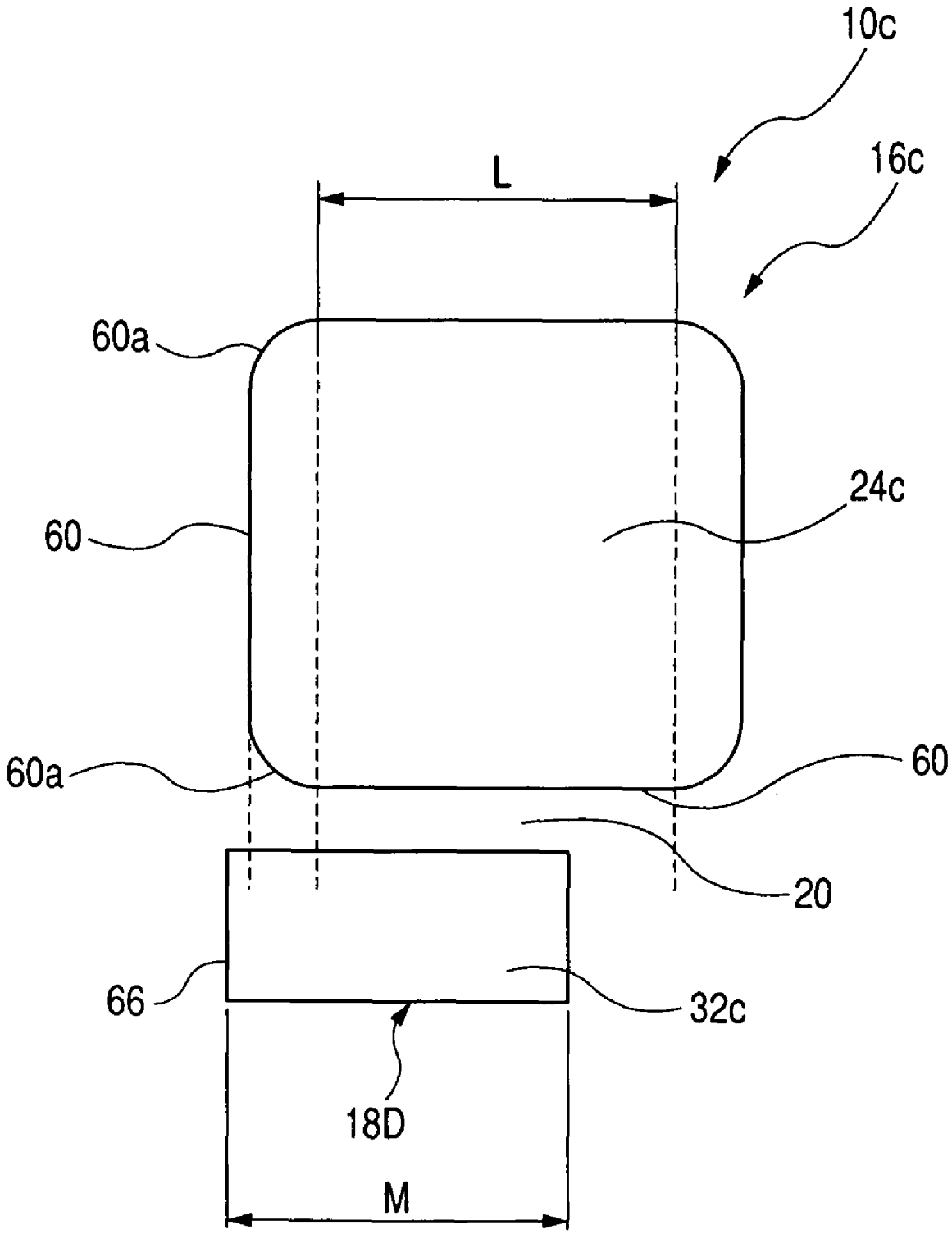
FIG. 20 is an illustrative view showing another positional relationship between the Ir alloy tip of the center electrode and the noble metal tip of the ground electrode, forming the spark plug of the second embodiment shown in FIG. 16, under a condition where the Ir alloy tip of the center electrode and the noble metal tip of the ground electrode are displaced from each other beyond the allowable limit.

That is, during assembly of the spark plug 10C, the center electrode 16C and the ground electrode 18D are arranged such that the sidewall 66 of the Ir alloy tip 32C of the ground electrode 18D does not protrude from the side surface 60 of the Ir alloy tip 24C as shown in a placement condition shown in FIG. 20.

Figure 19:
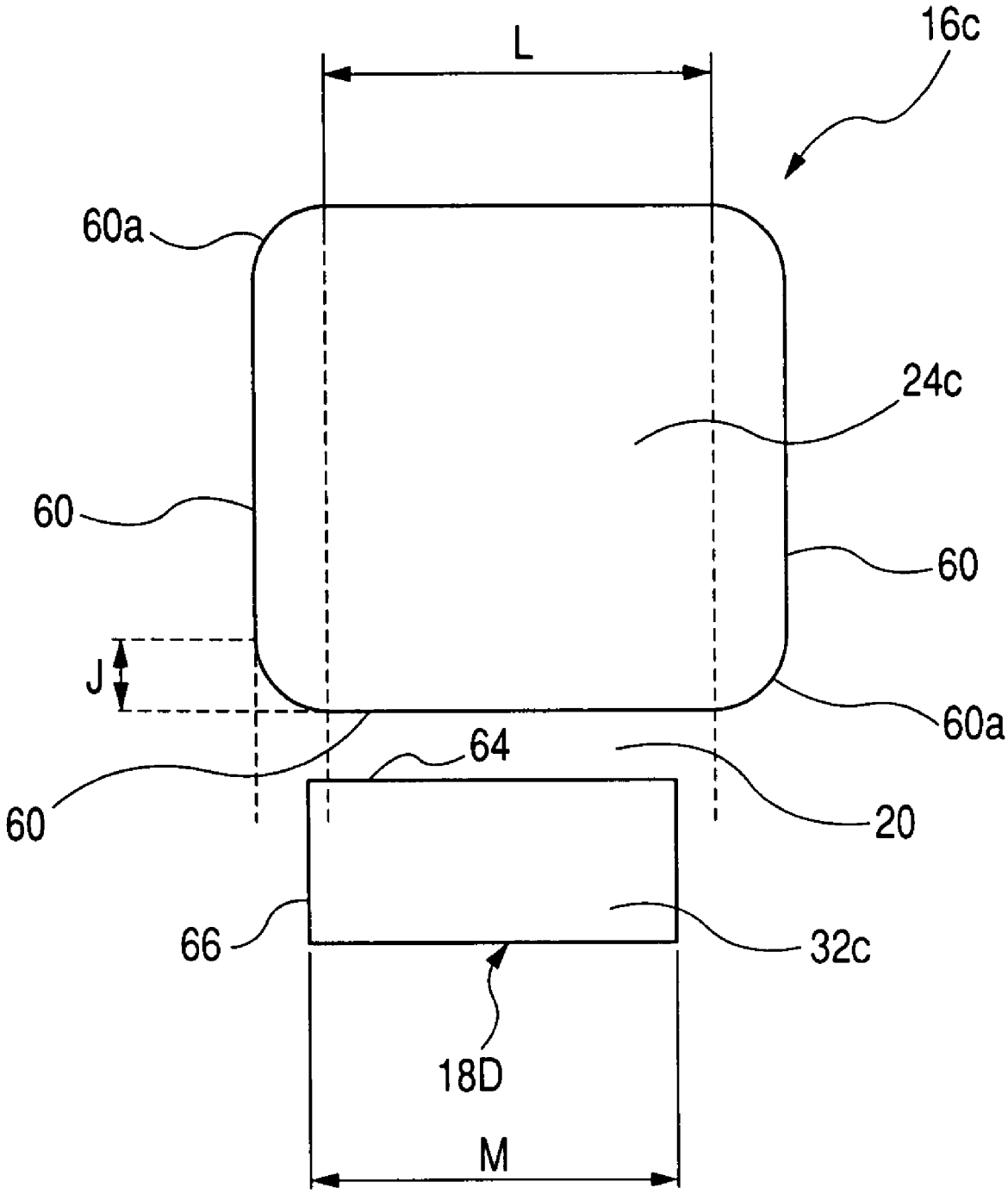
FIG. 19 is an illustrative view showing one positional relationship between the Ir alloy tip of the center electrode and the noble metal tip of the ground electrode, forming the spark plug of the second embodiment shown in FIG. 16, under a condition where the Ir alloy tip of the center electrode and the noble metal tip of the ground electrode are displaced from each other within an allowable limit.

As shown in FIG. 19, the curved portion 60*a* of the Ir alloy tip 24C of the center electrode 16C has a depth J, extending along the side surface 60 placed in face-to-face relationship with the side surface 64 of the Ir alloy tip 32C of the ground electrode 18D, which lies in a value less than 0.3 mm.

The spark plug 10C of the second embodiment has the same other structure as that of the spark plug 10 of the first embodiment shown in FIGS. 1 to 3.

Next, various advantageous effects of the spark plug 10C of the second embodiment are described below.

With the Ir alloy tip 24C formed in the substantially rectangular shape in cross section with the four corners formed with the curved portions 60*a*, a thermal stress is prevented from acting on the corner of the Ir alloy tip 24C in concentration. This provides an increase in bonding capability between the Ir alloy tip 24C and the center electrode base material body 22.

In addition, the length L of the straight portion of the side surface 60 and the width W of the Ir alloy tip 24C have the relationship expressed as $0.8\times W \leqq L < W$. This allows the Ir alloy tip 24C to have adequate opposing surface area in opposition to the ground electrode 18D, enabling the spark plug 10C to have increased operating life.

Further, the width M of the opposing surface 64 of the Ir alloy tip 32C of the ground electrode 18D, placed in face of the side surface 60 of the Ir alloy tip 24C of the center electrode 16C, and the length L of the straight portion of the side surface 60 of the Ir alloy tip 24C have the relationship expressed as $M<L$. This results in a capability for the Ir alloy tip 32C of the ground electrode 18D and the straight portion of the side surface 60 of the Ir alloy tip 24C of the center electrode 16C to easily achieve a spark discharge, enabling the Ir alloy tip 24C to have prolonged life time.

Furthermore, the center electrode 16C and the ground electrode 18D are set such that the opposing surface 64 of the Ir alloy tip 32C does not protrude from the side surface 60 of the Ir alloy tip 24C. Therefore, the Ir alloy tip 24C of the center electrode 24C and the Ir alloy tip 32C of the ground electrode 18D can face each other in an adequate surface area, thereby achieving prolonged operating life of the sparkplug 10C.

Moreover, the Ir alloy tip 24C, having the corners each formed with the curved portion 60*a* having the depth J falling in a value less than 0.3 mm, enables the prevention of a reduction in an opposing surface area between the Ir alloy tip 32C of the ground electrode 18D and the Ir alloy tip 24C of the center electrode 16C. This makes it possible to achieve prolonged operating life of the Ir alloy tip 24C.

That is, under a situation where the depth J of the curved portion 60*a* of the Ir alloy tip 24C exceeds 0.3 mm, if the curved portion 60*a* of the Ir alloy tip 24C of the center electrode 16C is placed in face of the opposing surface 64 of the Ir alloy tip 32C of the ground electrode 18D, the side surface 60 of the Ir alloy tip 24C is worn on an early stage with a fear of the occurrence of a reduction in operating life of the Ir alloy tip 24C. That is, with the spark discharge gap 20 enlarged to a value greater than 0.3 mm, the misfiring is apt to occur. In this case, with the corner 60*a* of the Ir alloy tip 24C having the depth J exceeding a value of 0.3 mm, the spark plug 10C has an increase in a range where the spark discharge gap 20, defined between the curved portion 60*a* of the Ir alloy tip 24C of the center electrode 16C and the Ir alloy tip 32C of the ground electrode 18D, exceeds a value of 0.3 mm on an early stage with the resultant fear of an appropriate opposing surface area decreasing on an early stage.

Therefore, as set forth above, the presence of the Ir alloy tip 24C having the corners with each depth J falling in a value less than 0.3 mm enables the prevention of a reduction in an opposing surface area of the Ir alloy tip 24C of the center electrode 16C, thereby enabling the spark plug 10C to have prolonged operating life.

In addition, the spark plug 10C of the present embodiment has the other advantageous effects as those of the spark plug 1 of the first embodiment mentioned above.

Third Embodiment

A spark plug 10E of a third embodiment according to the present invention is described with reference to FIG. 21.

Figure 21:
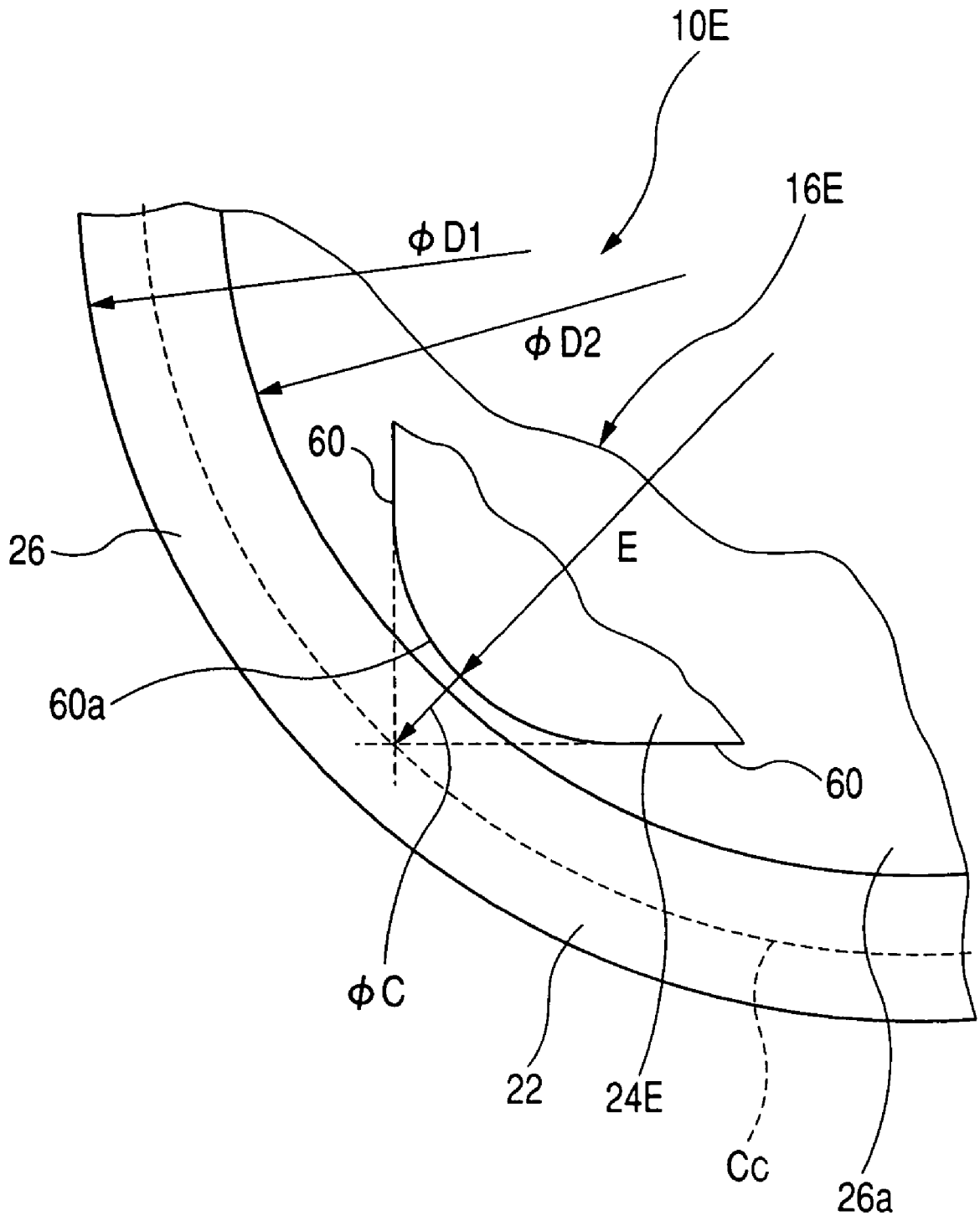
FIG. 21 is an illustrative view of a spark plug of a third embodiment according to the present invention showing a positional relationship between a corner portion of an Ir alloy tip of the center electrode and a center electrode base material body.

With the spark plug 10E of the present embodiment, as shown in FIG. 21, an Ir alloy tip 24E of a center electrode 16E has a substantially square shape in cross section with four corners each formed with a curved portion (rounded chamfered portion) 60*a* that is placed in an area on a contour of the base material leading end portion 26*a* of the center electrode base material body 22 or within the contour of the base material leading end portion 26*a*.

Even with such a structure of the center electrode 16E, the Ir alloy tip 24E and the center electrode base material body 22 are specified in the dimensional relationship and configurations as explained below to obtain the same advantageous effects as those of the spark plug 10 of the first embodiment set forth above.

That is, it is supposed that, among diagonal lines of the substantially rectangular shapes of the Ir alloy tip 24E, a long diagonal line has a length E. In addition, suppose that a square shape is defined with four straight portions 60 of the substantially rectangular shape of the Ir alloy tip 24E and a virtual circumscribed circle $C_C$ is defined with a diameter, equal to the long diagonal line among the diagonal lines of the square shape, which is designated as "C". Then, the relationship is established as $D1>C>D2$.

That is, as shown in FIG. 21, even if the diameter D2 of the base material leading end portion 26*a* and the length of the diagonal line E fall in the relationship expressed as $D2 \geqq E$, the center electrode 16E may be suffice to satisfy the relationship expressed as $D1>C>D2$.

The spark plug 10E of the third embodiment has the other features as those of the spark plug 10C of the second embodiment set forth above.

With such relationships established, even if the curved portion 60*a* of the Ir alloy tip 24E is located in an area inside the base material leading end portion 26*a* of the center electrode 16E, the virtual circumscribed circle $C_C$ is disposed in an area between the contour of the base material body 26 and the contour of the base material leading end portion 26*a*. This allows the spark plug 10E to have the same advantageous effects as those of the spark plug 10 of the first embodiment, enabling the center electrode base material body 22 and the Ir alloy tip 24E to have increased bonding capability.

In addition, the spark plug 10E of the third embodiment has other advantageous effects as those of the spark plug 10C of the second embodiment.

(First Evaluation Test)

Various spark plugs were prepared as test pieces to check states in which the fused layers 30 were formed with the Ir alloy tips 24 bonded to the center electrode base bodies 22 with the base material leading end portions 26*a* having three different diameters D2. The base material main bodies 26 had the diameters D1 of 2.9 mm. In addition, the Ir alloy tips 24 had a square shape in cross section with 2.7 mm on a side.

Figure 22A:
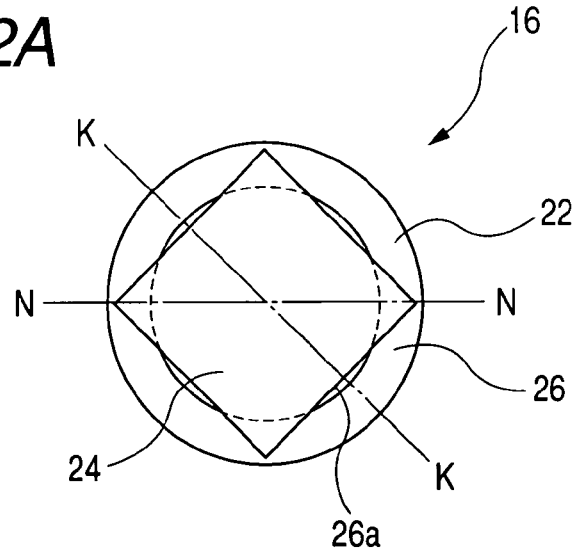
FIG. 22A is a plan view of a center electrode, as viewed from a distal end of an Ir alloy tip bonded to a base material leading end portion with a diameter D2 of 2.1 mm, on which a first evaluation test was conducted.
Figure 22B:
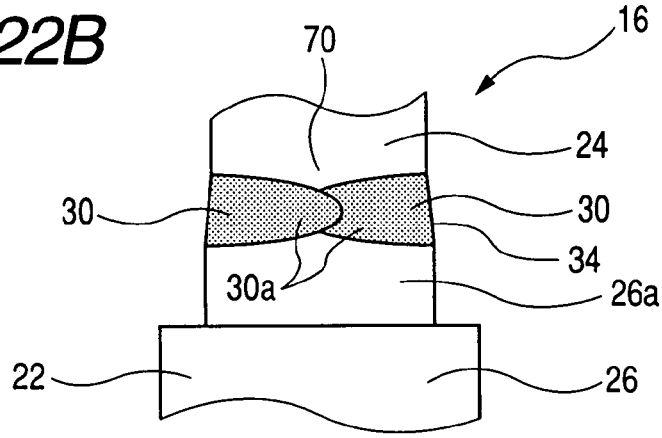
FIG. 22B is a cross-sectional view of the center electrode taken on line K-K of FIG. 22A.
Figure 22C:
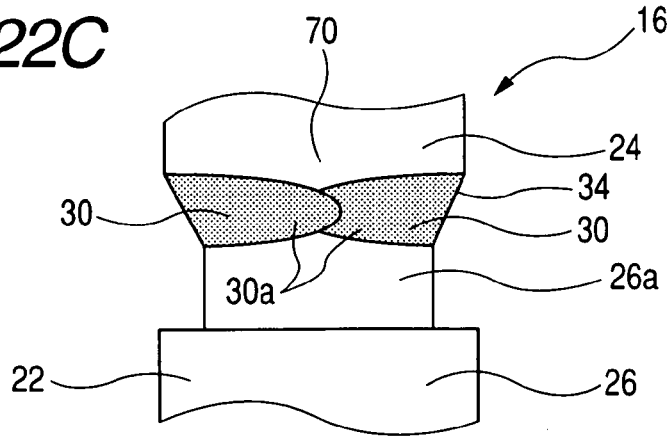
FIG. 22C is a cross-sectional view of the center electrode taken on line N-N of FIG. 22A.
Figure 23A:
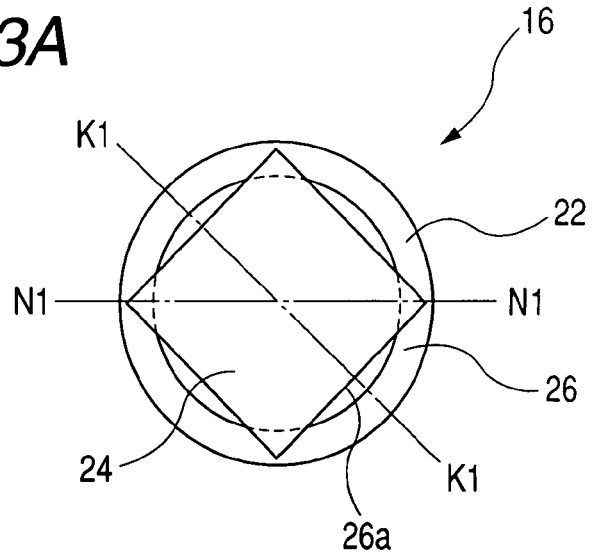
FIG. 23A is a plan view of a center electrode, as viewed from a distal end of an Ir alloy tip bonded to a base material leading end portion with a diameter D2 of 2.4 mm, on which a second evaluation test was conducted.
Figure 23B:
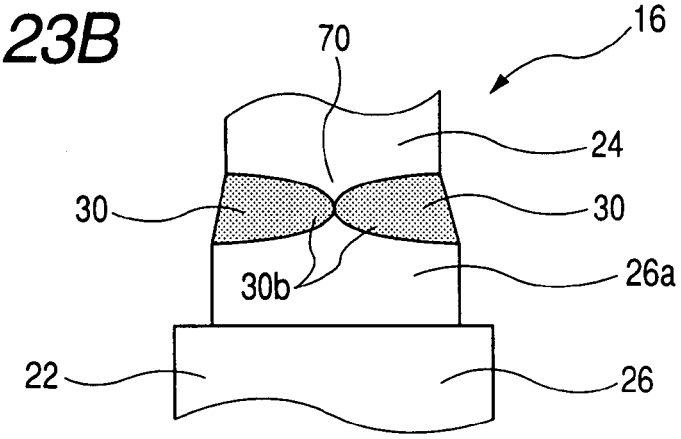
FIG. 23B is a cross-sectional view of the center electrode taken on line K1-K1 of FIG. 23A.
Figure 23C:
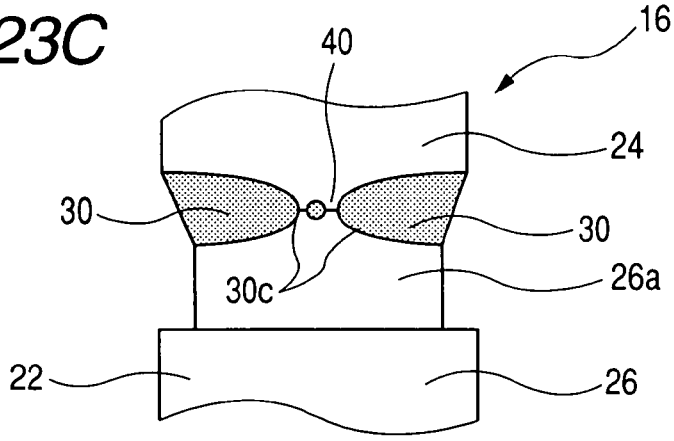
FIG. 23C is a cross-sectional view of the center electrode taken on line N1-N1 of FIG. 23A.
Figure 24A:
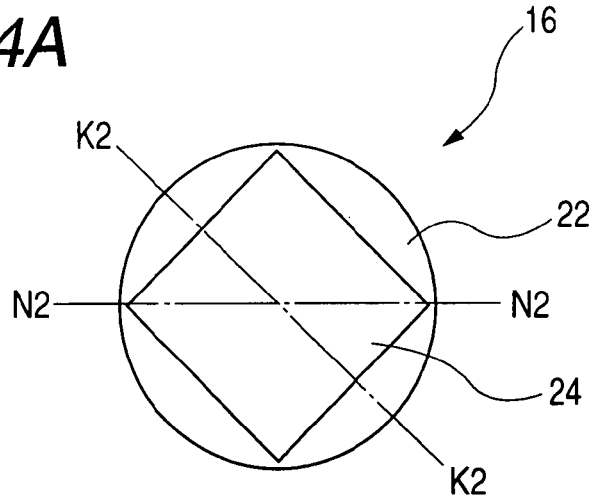
FIG. 24A is a plan view of a center electrode, as viewed from a distal end of an Ir alloy tip bonded to a base material leading end portion with a diameter D2 of 2.9 mm, on which a third evaluation test was conducted.
Figure 24B:
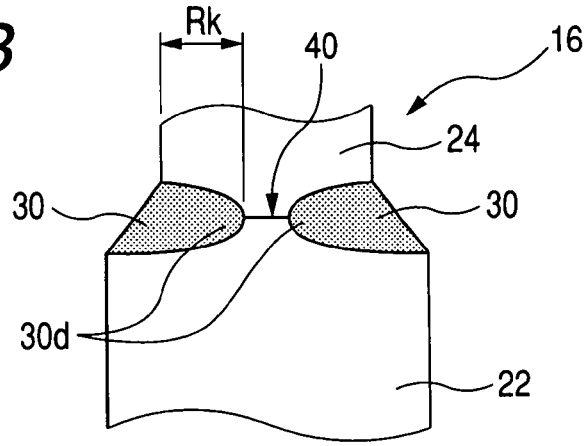
FIG. 24B is a cross-sectional view of the center electrode taken on line K2-K2 of FIG. 24A.
Figure 24C:
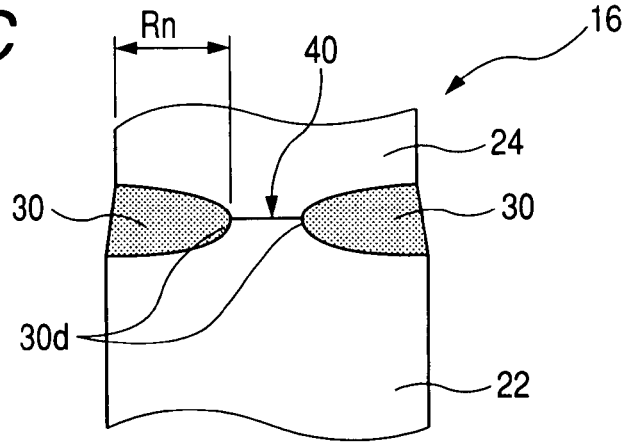
FIG. 24C is a cross-sectional view of the center electrode taken on line N2-N2 of FIG. 24A.

FIGS. 22A, 23A and 24A are views showing the Ir alloy tip 24 and the center electrode base bodies 22 of the center electrode 16 as viewed from the leading end thereof. FIGS. 22B, 23B and 24B are views of the center electrode 16 taken on line K-K of FIGS. 22A, 23A and 24A, respectively. FIGS. 22C, 23C and 24C are views of the center electrode 16 taken on line N-N of FIGS. 22A, 23A and 24A, respectively.

In this Evaluation Test, the base material leading end portions 26*a* were prepared in diameter D2 of 2.1 mm, 2.4 mm and in diameter of D1=D2=2.9 mm in the same structure as that of the related art center electrode in which no base material leading end portions 26*a* were prepared under which laser welding was performed in the same condition as that shown in FIGS. 12 and 13 conducted in the first embodiment. The resulting fused layers 30 are shown in FIGS. 22B, 22C, FIGS. 23B, 23C and FIGS. 24B and 24C.

As shown in FIGS. 22B and 22C, with the base material leading end portion 26*a* having the diameter D2 of 2.1 mm, the fused layer 30 had overlapping portions 30*a* formed in a center portion 70 of the joint portion 34 between the Ir alloy tip 24 and the base material leading end portions 26*a* with no formation of the unfused area 40. As shown in FIG. 23B, with the base material leading end portion 26*a* having the diameter D2 of 2.4 mm, the fused layer 30 had abutting portions 30*b* formed in the center portion 70 of the joint portion 34 between the Ir alloy tip 24 and the base material leading end portions 26*a*. With the structure of the center electrode 16 shown in FIG. 23C, the fused layer 30 had the deepest ends 30*c* with the unfused region 40 remained in a slight area. However, the width F of such an unfused area 40 and the diameter A of the circumscribed circle $C_A$ of the Ir alloy tip satisfies the relationship $F \leqq 0.2 \times A$ (see FIGS. 1 and 7 of the first embodiment).

Meanwhile, as shown in FIGS. 24B and 24C, with the base material leading end portion 26*a* having the diameter D2 of 2.9 mm, the fused layer 30 had the deep ends 30*d*, 30*d* with the formation of a comparatively large unfused region 40.

(Second Evaluation Test)

Figure 25:
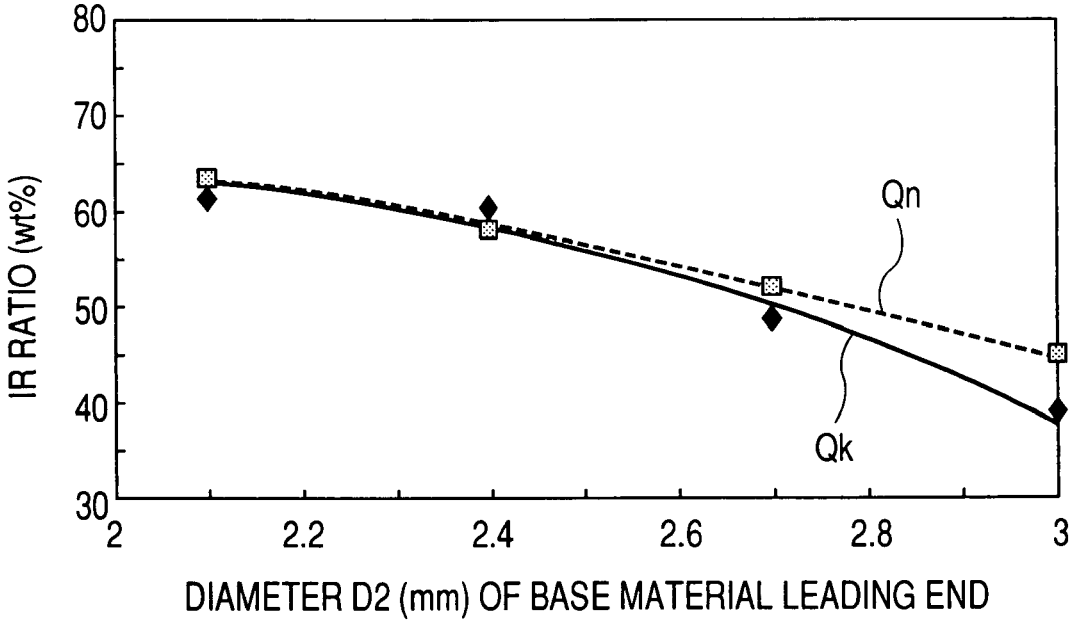
FIG. 25 is a graph showing the relationship between a diameter D2 of a base material leading end portion and an Ir ratio (wt %) of the center electrode.
Figure 26:
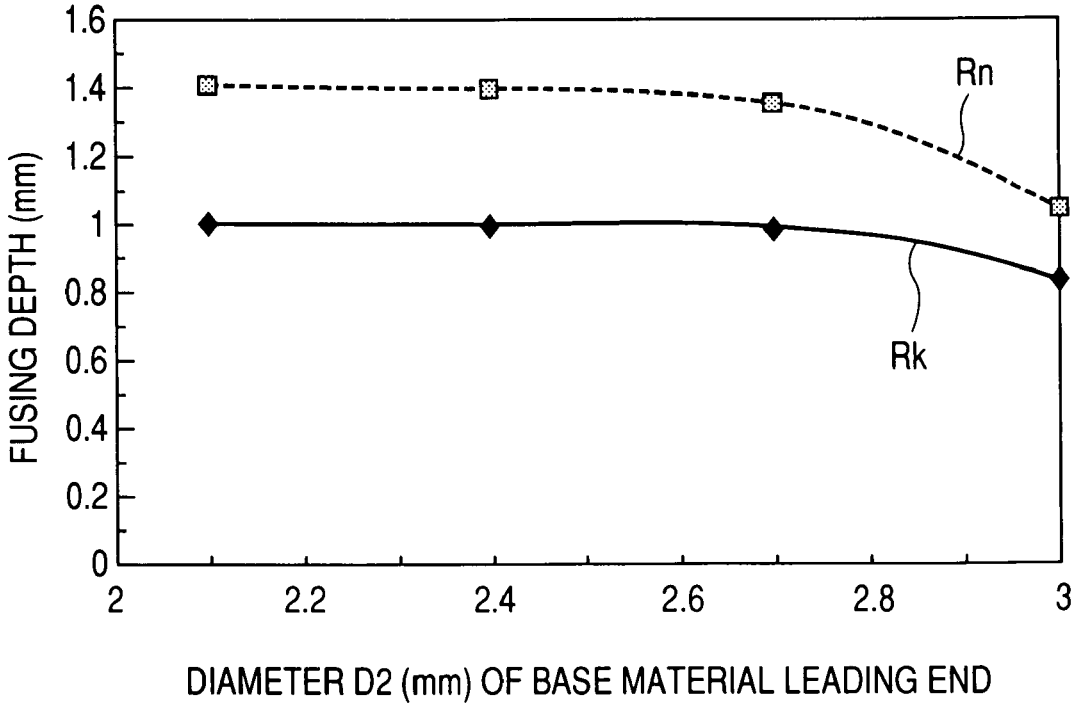
FIG. 26 is a graph showing the relationship between a diameter D2 of a base material leading end portion and a fusing depth (mm) of the center electrode.
Figure 27:
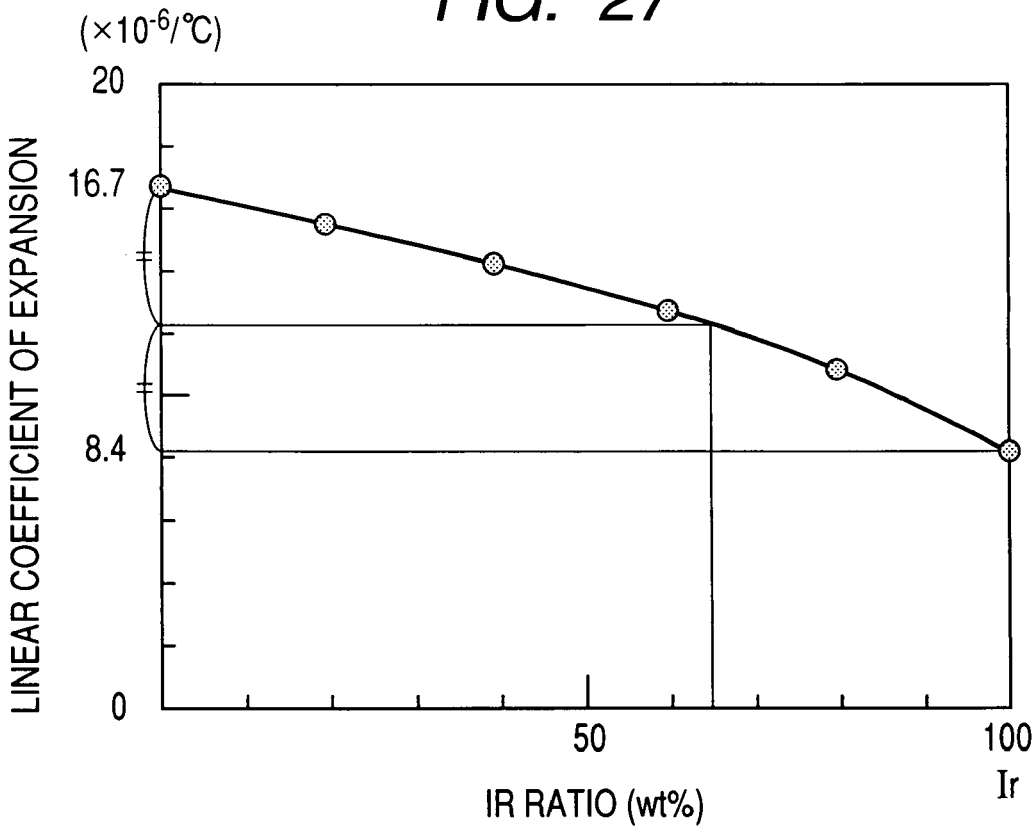
FIG. 27 is a graph showing the relationship between an Ir ratio (%) of a fused layer and a thermal expansion coefficient of the fused layer.

Various spark plugs were prepared with the base material leading end portions 26*a* formed in various diameters D2 to check bonding capabilities of the spark plugs, with the measured results being plotted in FIGS. 25 to 27.

Moreover, the base material body 26 of the center electrode 16 had a diameter D1 of 3.0 mm.

FIG. 25 shows a graph showing an Ir content (a ratio of Ir content) in the fused layer 30 by weight % plotted in terms of the diameter D2 of the base material leading end portions 26*a*. Analyzed results on the Ir content appearing in cross section taken on line K-K are indicated as Qk and analyzed results on the Ir content appearing in cross section taken on line N-N are indicated as Qn.

Further, FIG. 26 shows the relationship between the diameter D2 and a fusion depth Rk of the fused layer appearing in cross section taken on line K-K and a fusion depth Rn of the fused layer appearing in cross section taken on line N-N. The fusion depths Rk, Rn represent dimensions shown in FIG. 24.

Furthermore, FIG. 27 shows variation in a linear coefficient of expansion in terms of ratio of Iridium (Ir) to Inconel (Ni alloy) forming the center electrode base material body 22. The center electrode base material body 22 has a linear coefficient of expansion laying at a value nearly intermediate between those of Inconel and Iridium with the Ir ratio remaining in the vicinity of 65% by weight.

Figure 28:
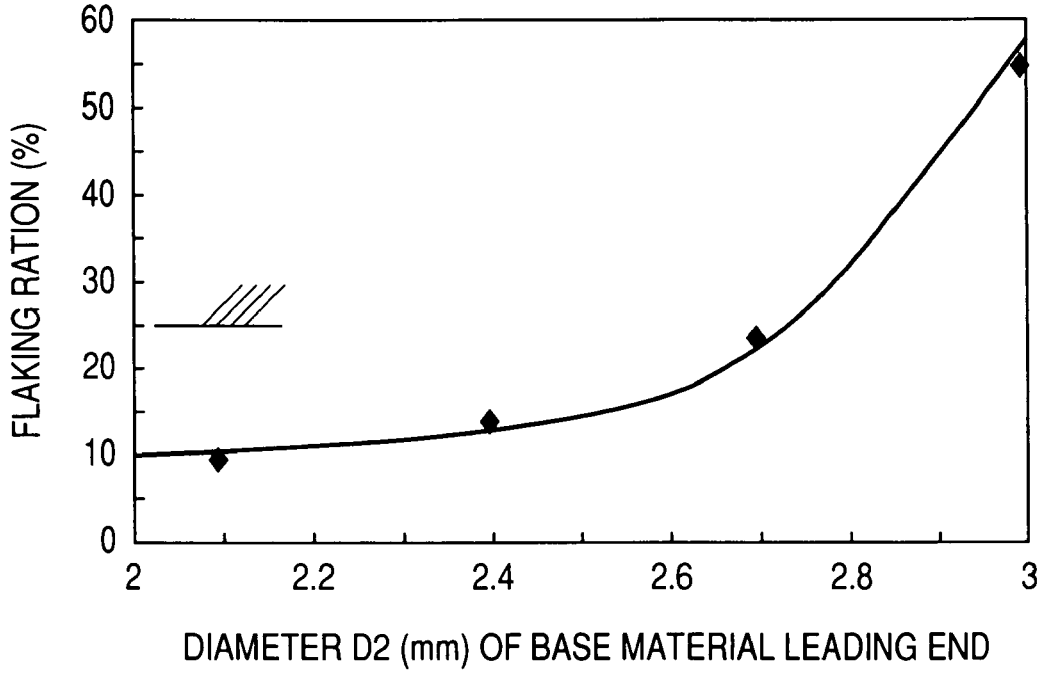
FIG. 28 is a graph showing the relationship between a flaking incidence rate (%) of an Ir alloy tip from a base material body of a center electrode and a diameter D2 of a base material leading end portion.
Figure 29:
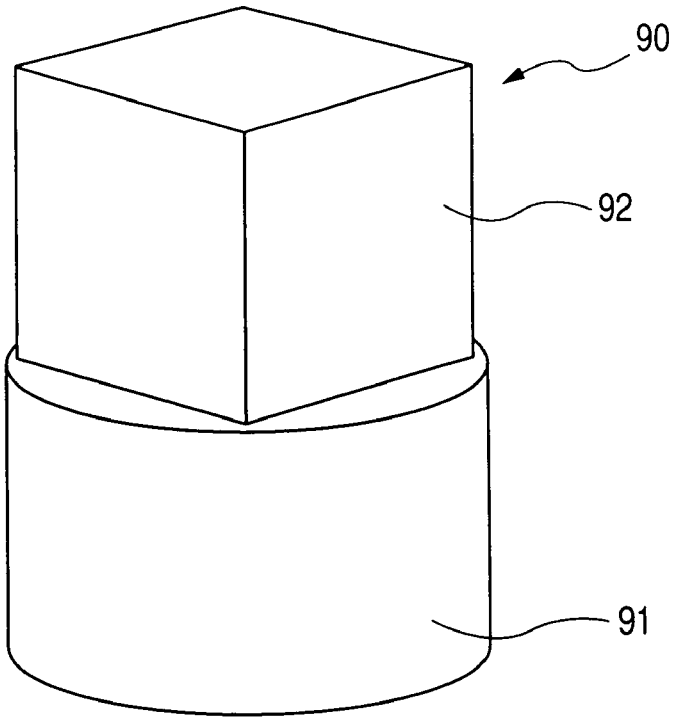
FIG. 29 (PRIOR ART)
FIG. 29 is a perspective view showing a spark plug of the related art.
Figure 30:
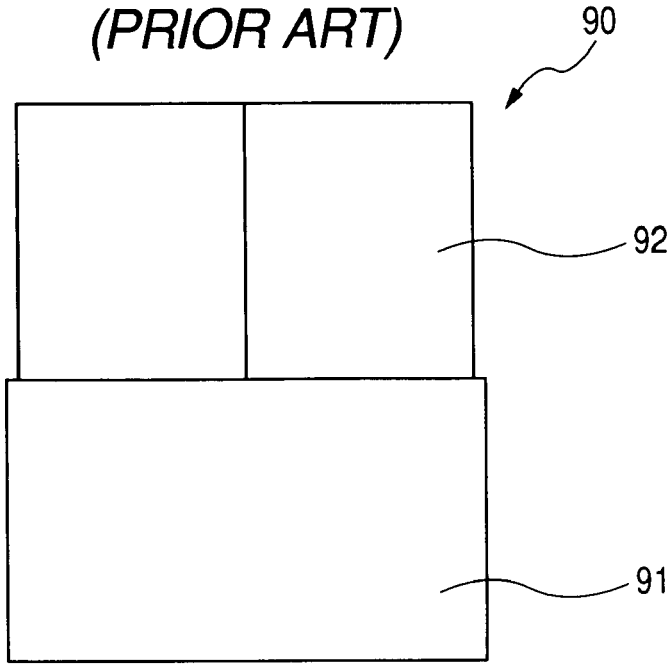
FIG. 30 (PRIOR ART)
FIG. 30 is a side view showing the spark plug of the related art shown in FIG. 29.
Figure 31:
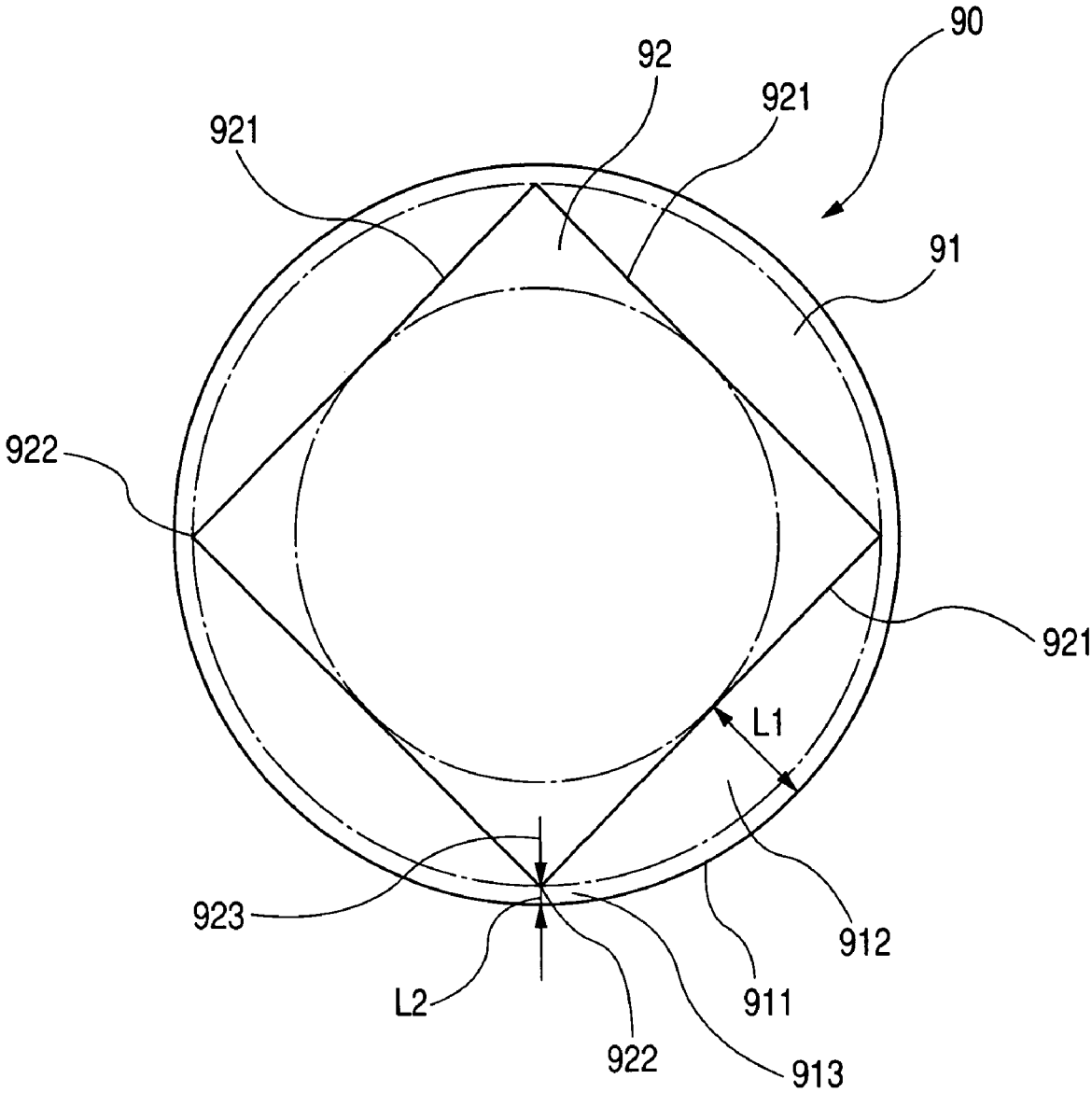
FIG. 31 (PRIOR ART)
FIG. 31 is a plan view of the spark plug of the related art, shown in FIG. 29, as viewed from a distal end of a center electrode.
Figure 32:
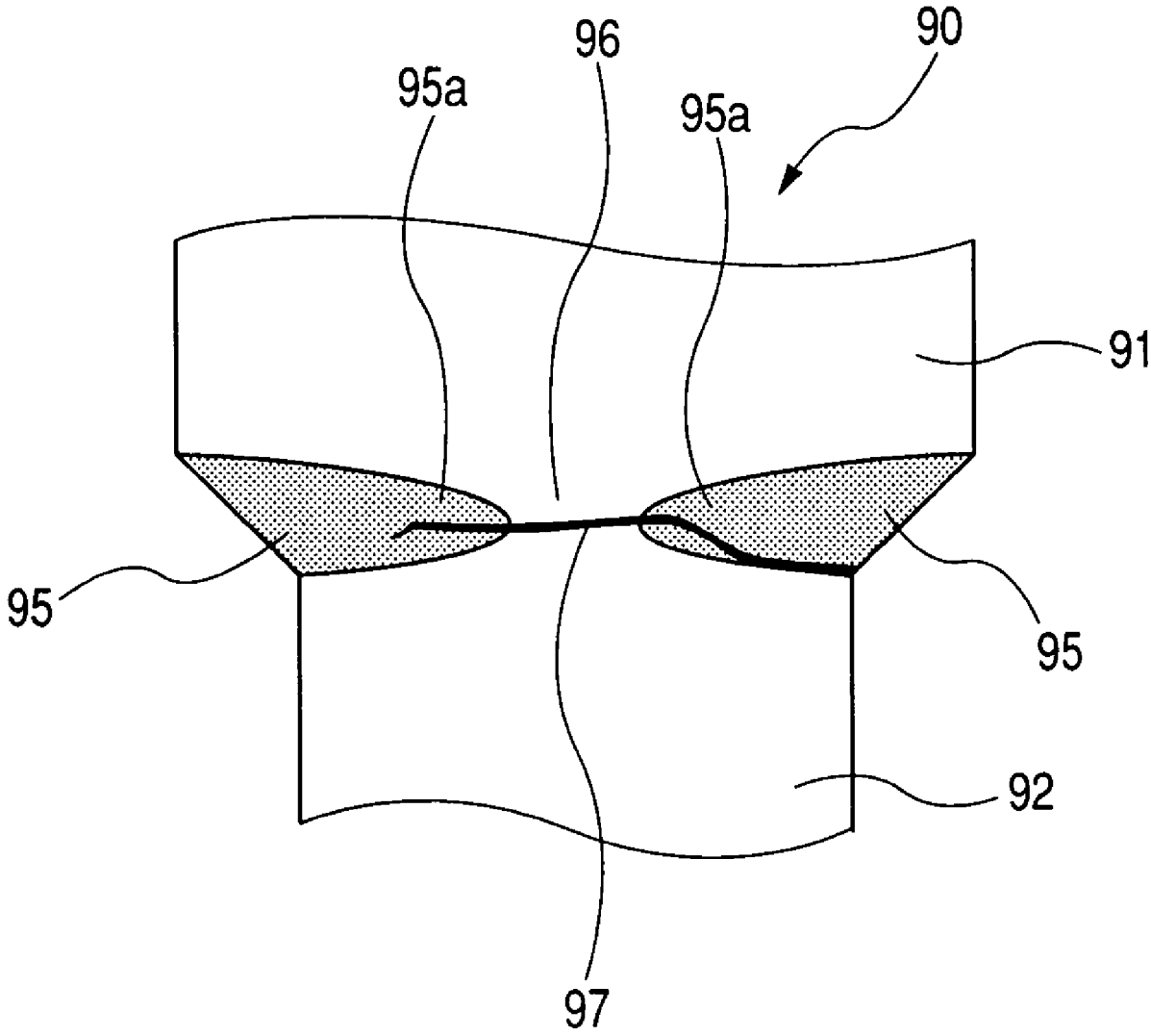
FIG. 32 (PRIOR ART)
FIG. 32 is an enlarged illustrative view showing the center electrode encountered with cracking occurred in a fused layer.

Moreover, FIG. 28 shows a flaking incidence rate (%) between the center electrode base material body 22 and the Ir alloy tip 24 on thermal shock endurance tests in terms of the diameter D2 of the base material leading end portion 26*a*. The thermal shock endurance tests were conducted on test pieces that included the center electrodes 16, each composed of the center electrode base material body 22 and the Ir alloy tip 24, which were placed in an atmosphere under 900° C. for six minutes and, thereafter, left at room temperature of 25° C. for six minutes. Such thermal shock endurance cycles were conducted in repeated cycles of 400 times. In obtaining the flaking incidence rate, tests were conducted on eight pieces of samples for each level to check a length of flaked area in the joint portion of the center electrode 16 in cross section taken on line K-K and a length of a welded area of the center electrode 16. These factors were measured and an average value in ratio between these factors was calculated as the flaking incidence rate.

As will be apparent from FIG. 25, the spark plug of the related art having a center electrode with D1=D2=3.0 mm with no provision of the base material leading end portion 26*a* undergoes an increased difference in Ir ratio appearing on the joint portion of the center electrode in cross section taken on lines K-K and N-N and the resulting Ir ratios have lower values than an idealistic value of 65% by weight.

As will be apparent from FIG. 26, further, the center electrode, falling in the relationship of D1=D2=3.0 mm, have the fusion depths Rk, Rn that are low with respect to D1, D2 in the presence of an increase in the unfused are 40 (see FIG. 24).

Therefore, as shown in FIG. 28, in case of the center electrode with D1=D2=3.0 mm, the flaking incidence rate increases to a value of 50%.

Further, in case of the center electrode with D2=2.7 mm, the Ir ratio exceeds a value of 50% (see FIG. 25) and the unfused area is present only in small area (see FIG. 23) with the flaking incidence rate decreased to be less than a value of 25% (see FIG. 28).

Furthermore, in case of the center electrode with D2 less than 2.4 mm, the Ir ratio is stabilized in a region in the vicinity of 65% (see FIG. 25) and, as shown in FIGS. 22B and 22C, the fused layer 30 had the overlapping portions 30*a* in the absence of the unfused portion 40. The flaking incidence rate was found to be less than 15% (see FIG. 28). It is thus confirmed that the sparks plugs of the present invention can have the center electrodes favorably welded conditions.

While the specific embodiment of the present invention has been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A spark plug for an internal combustion engine, comprising:

a metal shell having an outer periphery formed with a mounting thread;

a porcelain insulator fixedly secured to the metal shell on a central axis thereof;

a center electrode retained within the porcelain insulator along a central axis thereof; and a ground electrode extending from the metal shell and having a leading end placed in face-to-face relationship with the center electrode to provide a spark discharge gap;

the center electrode including a center electrode base material body of a substantially columnar shape having a base material leading end portion, and a substantially square shaped rod-like Ir alloy tip bonded to the base material leading end portion of the center electrode base material body; and the base material leading end portion of the center electrode base material body having a columnar shape with a diameter D2 smaller than a diameter D1 of the center electrode base material body;

wherein the square shaped rod-like Ir alloy tip has a square shape in cross section on a plane perpendicular to an axis of the Ir alloy tip with diagonal lines among which a long diagonal line is supposed to be a diameter A of a circumscribed circle $C_A$ of the Ir alloy tip and an inscribed circle $C_B$ is supposed to internally touch at least two sides of the square shape coaxially with the circumscribed circle $C_A$ of the Ir alloy tip and have a diameter B, with four diameters A, B, D1 and D2 lay in the relationship expressed as D1>A>D2>B;

the substantially square shape of the Ir alloy tip in cross section has corners formed in curved portions, respectively, and straight portions interconnecting the curved portions to each other; and wherein each straight portion has a length L and the Ir alloy tip has a width W under the relationship expressed as $0.8\times W \leqq L < W$.

2. The spark plug for the internal combustion engine according to claim 1, wherein:

the ground electrode includes a noble metal ship having an opposing surface, facing a sidewall of the Ir alloy tip to provide the spark discharge gap, which has a width M in relation to the length L of the straight portion under the relationship expressed as M<L.

3. The spark plug for the internal combustion engine according to claim 2, wherein:

the opposing surface of the noble metal tip of the ground electrode is placed in face-to-face relationship with the sidewall of the Ir alloy tip such that the opposing surface of the noble metal tip does not protrude from the sidewall of the Ir alloy tip.

4. The spark plug for the internal combustion engine according to claim 1, wherein:

the opposing surface of the noble metal tip of the ground electrode is placed in face-to-face relationship with a sidewall of the Ir alloy tip so as not to protrude from the sidewall of the Ir alloy tip in a widthwise direction thereof; and each of the curved portions of the Ir alloy tip has a depth less than 0.3 mm along a direction in which each curved portion faces the noble metal tip of the ground electrode.

5. The spark plug for the internal combustion engine according to claim 1, wherein:

the substantially square shape of the Ir alloy tip in cross section thereof has one of a substantially quadrate shape and a rectangular shape.

6. The spark plug for the internal combustion engine according to claim 1, wherein:

the substantially square shape of the Ir alloy tip in cross section has a profile including corners formed in curved portions, respectively, and straight portions interconnecting the curved portions to each other; and wherein a square shape is supposed to be defined with four extended lines of the straight portions with a length E of a long diagonal line among diagonal lines of the substantially square shape of the Ir alloy tip under which a virtual circumscribed circle $C_c$ is supposed to have a diameter C, corresponding to the long diagonal line among diagonal lines of the substantially square shape of the Ir alloy tip, which has the relationship expressed as D1>C>D2≧E.

7. The spark plug for the internal combustion engine according to claim 1, wherein:

the diameter D1 of the center electrode base material body and the diameter D2 of the base material leading end portion of the center electrode base material body lies in the relationship expressed as $0.5\times D1 \leqq D2 \leqq 0.95\times D1$.

8. The spark plug for the internal combustion engine according to claim 1, wherein:

the diameter D1 of the center electrode base material body and the diameter D2 of the base material leading end portion of the center electrode base material body lies in the relationship expressed as $07\times D1 \leqq D2 \leqq 0.9\times D1$.

9. The spark plug for the internal combustion engine according to claim 1, wherein:

the diameter D1 of the base material body of the center electrode base material body is greater than 2.5 mm.

10. The spark plug for the internal combustion engine according to claim 1, wherein:

the Ir alloy tip is bonded to the center electrode base material body at a joint portion in which a fused layer is formed with an unfused portion being formed inside the fused layer in a width F in a correlation with the diameter A of the circumscribed circle $C_A$ of the Ir alloy tip under the relationship expressed as $F \leqq 0.2\times A$.

11. The spark plug for the internal combustion engine according to claim 1, wherein:

the Ir alloy tip is bonded to the center electrode base material body at a joint portion formed with a fused layer having an entire circumference spaced from a bore end of a through-bore of the porcelain insulator by a distance greater than 0.1 mm.

12. The spark plug for the internal combustion engine according to claim 11, wherein:

the center electrode has an annular space defined between an insulator leading end portion and an outer periphery of the joint portion between the Ir alloy tip and the center electrode base material body; and the joint portion has an inward boundary edge exposed to the annular space of the center electrode.

13. The spark plug for the internal combustion engine according to claim 1, wherein:

the ground electrode comprises a ground electrode base body having a trailing end connected to the metal shell and a leading end to which a noble metal tip is bonded in face-to-face relationship with a sidewall of the center electrode to define the spark discharge gap.

14. The spark plug for the internal combustion engine according to claim 1, wherein:

the porcelain insulator has an insulator leading end portion axially extending through the metal shell and ended at a position axially inward of a leading end of the metal shell; and the base material leading end portion of the base material body is spaced from the insulator leading end portion of the porcelain insulator through an annular space;

wherein the joint portion between the Ir alloy tip and the base material leading end portion is exposed to the annular space between the base material leading end portion of the base material body and the insulator leading end portion of the porcelain insulator.

15. The spark plug for the internal combustion engine according to claim 14, wherein:

the Ir alloy tip and the base material leading end portion are bonded to each other at the joint portion through a fused layer having an inward boundary edge exposed to the annular space between the base material leading end portion of the base material body and the insulator leading end portion of the porcelain insulator.

16. The spark plug for the internal combustion engine according to claim 15, wherein:

the fused layer of the joint portion has an outer circumferential periphery spaced from the leading end portion of the porcelain insulator through the annular space by a given distance.

17. The spark plug for the internal combustion engine according to claim 1, wherein:

the curved portion of the Ir alloy tip of the center electrode has a depth falling in a value less than 0.3 mm.

18. A spark plug for an internal combustion engine, comprising:

a metal shell having an outer periphery formed with a mounting thread;

a porcelain insulator fixedly secured to the metal shell on a central axis thereof;

a center electrode retained within the porcelain insulator along a central axis thereof; and a ground electrode extending from the metal shell and having a leading end placed in face-to-face relationship with the center electrode to provide a spark discharge gap;

the center electrode including a center electrode base material body of a substantially columnar shape having a base material leading end portion, and a substantially square shaped rod-like Ir alloy tip bonded to the base material leading end portion of the center electrode base material body; and the base material leading end portion of the center electrode base material body having a columnar shape with a diameter D2 smaller than a diameter D1 of the center electrode base material body;

wherein the square shaped rod-like Ir alloy tip has a square shape in cross section on a plane perpendicular to an axis of the Ir alloy tip with diagonal lines among which a long diagonal line is supposed to be a diameter A of a circumscribed circle $C_A$ of the Ir alloy tip and an inscribed circle $C_B$ is supposed to internally touch at least two sides of the square shape coaxially with the circumscribed circle $C_A$ of the Ir alloy tip and have a diameter B, with four diameters A, B, D1 and D2 lay in the relationship expressed as D1>A>D2>B; and wherein:

the diameter D1 of the center electrode base material body and the diameter D2 of the base material leading end portion of the center electrode base material body lies in the relationship expressed as $0.5 \times D1 \leqq D2 \leqq 0.95 \times D1$.

19. A spark plug for an internal combustion engine, comprising:

a metal shell having an outer periphery formed with a mounting thread;

a porcelain insulator fixedly secured to the metal shell on a central axis thereof;

a center electrode retained within the porcelain insulator along a central axis thereof; and a ground electrode extending from the metal shell and having a leading end placed in face-to-face relationship with the center electrode to provide a spark discharge gap;

the center electrode including a center electrode base material body of a substantially columnar shape having a base material leading end portion, and a substantially square shaped rod-like Ir alloy tip bonded to the base material leading end portion of the center electrode base material body; and the base material leading end portion of the center electrode base material body having a columnar shape with a diameter D2 smaller than a diameter D1 of the center electrode base material body;

wherein the square shaped rod-like Ir alloy tip has a square shape in cross section on a plane perpendicular to an axis of the Ir alloy tip with diagonal lines among which a long diagonal line is supposed to be a diameter A of a circumscribed circle $C_A$ of the Ir alloy tip and an inscribed circle $C_B$ is supposed to internally touch at least two sides of the square shape coaxially with the circumscribed circle $C_A$ of the Ir alloy tip and have a diameter B, with four diameters A, B, D1 and D2 lay in the relationship expressed as D1>A>D2>B; and wherein:

the Ir alloy tip is bonded to the center electrode base material body at a joint portion formed with a fused layer having an entire circumference spaced from a bore end of a through-bore of the porcelain insulator by a distance greater than 0.1 mm.

20. The spark plug for the internal combustion engine according to claim 19, wherein:

the center electrode has an annular space defined between an insulator leading end portion and an outer periphery of the joint portion between the Ir alloy tip and the center electrode base material body; and the joint portion has an inward boundary edge exposed to the annular space of the center electrode.

* * * * *